US007643050B2

(12) United States Patent
Nakagawa

(10) Patent No.: US 7,643,050 B2
(45) Date of Patent: Jan. 5, 2010

(54) OPTICAL SIGNAL GENERATING APPARATUS, OPTICAL SIGNAL GENERATING METHOD, AND IMAGE FORMING APPARATUS

(75) Inventor: Jun Nakagawa, Hachioji (JP)

(73) Assignee: Konica Minolta Business Technologies, Inc., Tokyo (JP)

( * ) Notice: Subject to any disclaimer, the term of this patent is extended or adjusted under 35 U.S.C. 154(b) by 73 days.

(21) Appl. No.: 11/876,661

(22) Filed: Oct. 22, 2007

(65) Prior Publication Data

US 2008/0062243 A1 Mar. 13, 2008

Related U.S. Application Data

(62) Division of application No. 11/134,588, filed on May 19, 2005, now abandoned.

(30) Foreign Application Priority Data

Aug. 16, 2004 (JP) ..... 2004-236682
Mar. 16, 2005 (JP) ..... 2005-076008

(51) Int. Cl.
*B41J 2/47* (2006.01)

(52) U.S. Cl. ..... 347/239; 347/255

(58) Field of Classification Search ..... 347/135, 347/136, 239, 251–255, 240; 359/290–292, 359/298, 211.6, 230, 231; 382/235
See application file for complete search history.

(56) References Cited

U.S. PATENT DOCUMENTS 4,885,786 A * 12/1989 Anderson et al. ..... 382/235
6,025,859 A 2/2000 Ide et al.
6,084,626 A 7/2000 Ramanujan et al.
6,147,789 A 11/2000 Gelbart
6,650,354 B2 11/2003 Morizono et al.
7,057,795 B2 * 6/2006 Hunter et al. ..... 359/291

FOREIGN PATENT DOCUMENTS

JP 2000-131628 A 5/2000

* cited by examiner

*Primary Examiner*—Hai C Pham
(74) *Attorney, Agent, or Firm*—Frishauf, Holtz, Goodman & Chick, P.C.

(57) ABSTRACT

An information recording apparatus for recording image information on an image forming body, the apparatus including: a light source for emitting light; a light valve of diffraction grating type, for modulating the light emitted from the light source according to the image information, the light valve comprising a plurality of ribbons arranged in an array; and an optical section for forming an image on the image forming body with the light diffracted and modulated by the light valve, wherein a longitudinal direction of the ribbons of the light valve is arranged at a specific angle with respect to a direction perpendicular to the array direction of the ribbons.

7 Claims, 19 Drawing Sheets

11: ORIGINAL READING SECTION 60: IMAGE WRITING SECTION 70: IMAGE FORMING SECTION (WHEN APPLIED VOLTAGE OFF)

(WHEN APPLIED VOLTAGE ON)

FIG. 7 ( A )
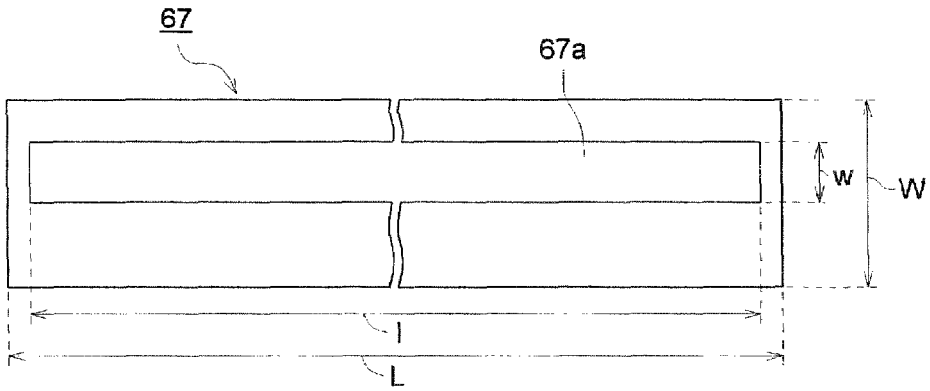
FIG. 7 ( B )
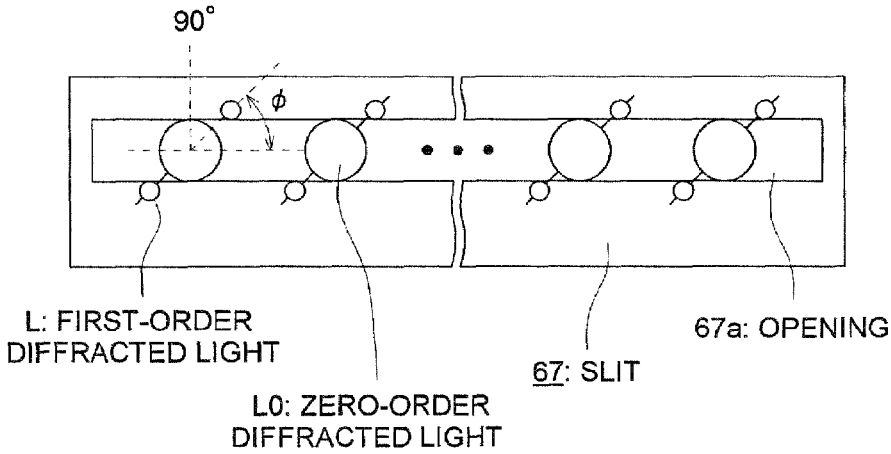

PATTERN DATA Pi [ j ] IMAGE DATA (DL, DC, DR)

j = 1 j = 2 j = 3

P1

| | | |
|---|---|---|
| 1 | 0 | 0 |
| 1 | 0 | 0 |
| 1 | 1 | 0 |

j = 4 j = 5 j = 6 j = 7 j = 8 j = 9

(1,0,0)

FIG. 13 ( A )

P2

| | | |
|---|---|---|
| 1 | 1 | 0 |
| 1 | 0 | 0 |
| 1 | 0 | 0 |

(1,0,0)

FIG. 13 ( B )

P3

| | | |
|---|---|---|
| 1 | 0 | 0 |
| 1 | 1 | 0 |
| 1 | 1 | 0 |

(1,1,0)

FIG. 13 ( C )

P4

| | | |
|---|---|---|
| 1 | 1 | 0 |
| 1 | 1 | 0 |
| 1 | 0 | 0 |

(1,1,0)

FIG. 13 ( D )

PATTERN DATA Pi [ j ] IMAGE DATA (DL, DC, DR)

P5

| | | |
|---|---|---|
| 0 | 0 | 1 |
| 0 | 0 | 1 |
| 0 | 1 | 1 |

(0,0,1)

FIG. 13 ( E )

P6

| | | |
|---|---|---|
| 0 | 1 | 1 |
| 0 | 0 | 1 |
| 0 | 0 | 1 |

(0,0,1)

FIG. 13 ( F )

P7

| | | |
|---|---|---|
| 0 | 0 | 1 |
| 0 | 1 | 1 |
| 0 | 1 | 1 |

(0,1,1)

FIG. 13 ( G )

P8

| | | |
|---|---|---|
| 0 | 1 | 1 |
| 0 | 1 | 1 |
| 0 | 0 | 1 |

(0,1,1)

FIG. 13 ( H )

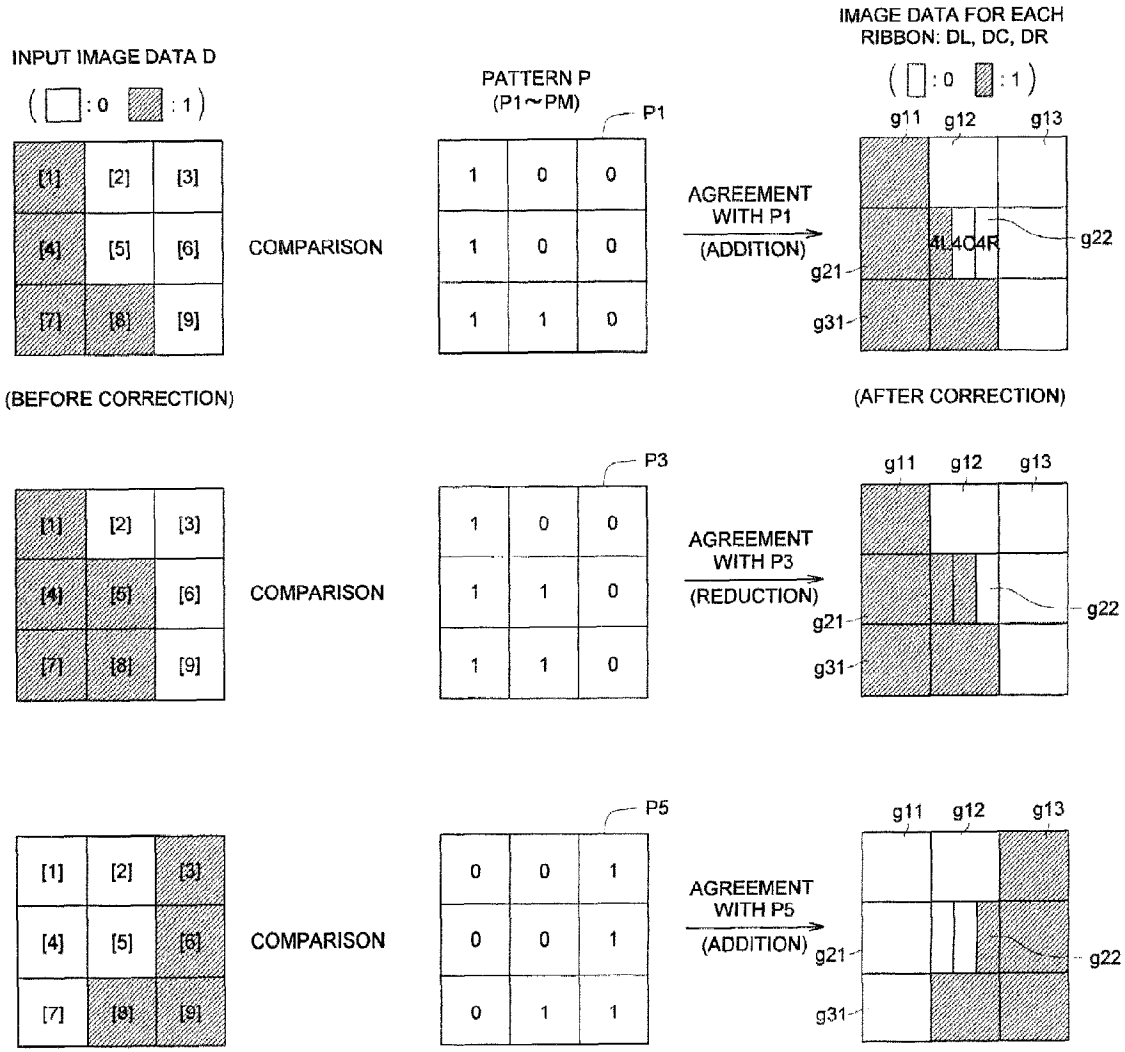
FIG. 14 ( A )
FIG. 14 ( B )
FIG. 14 ( C )

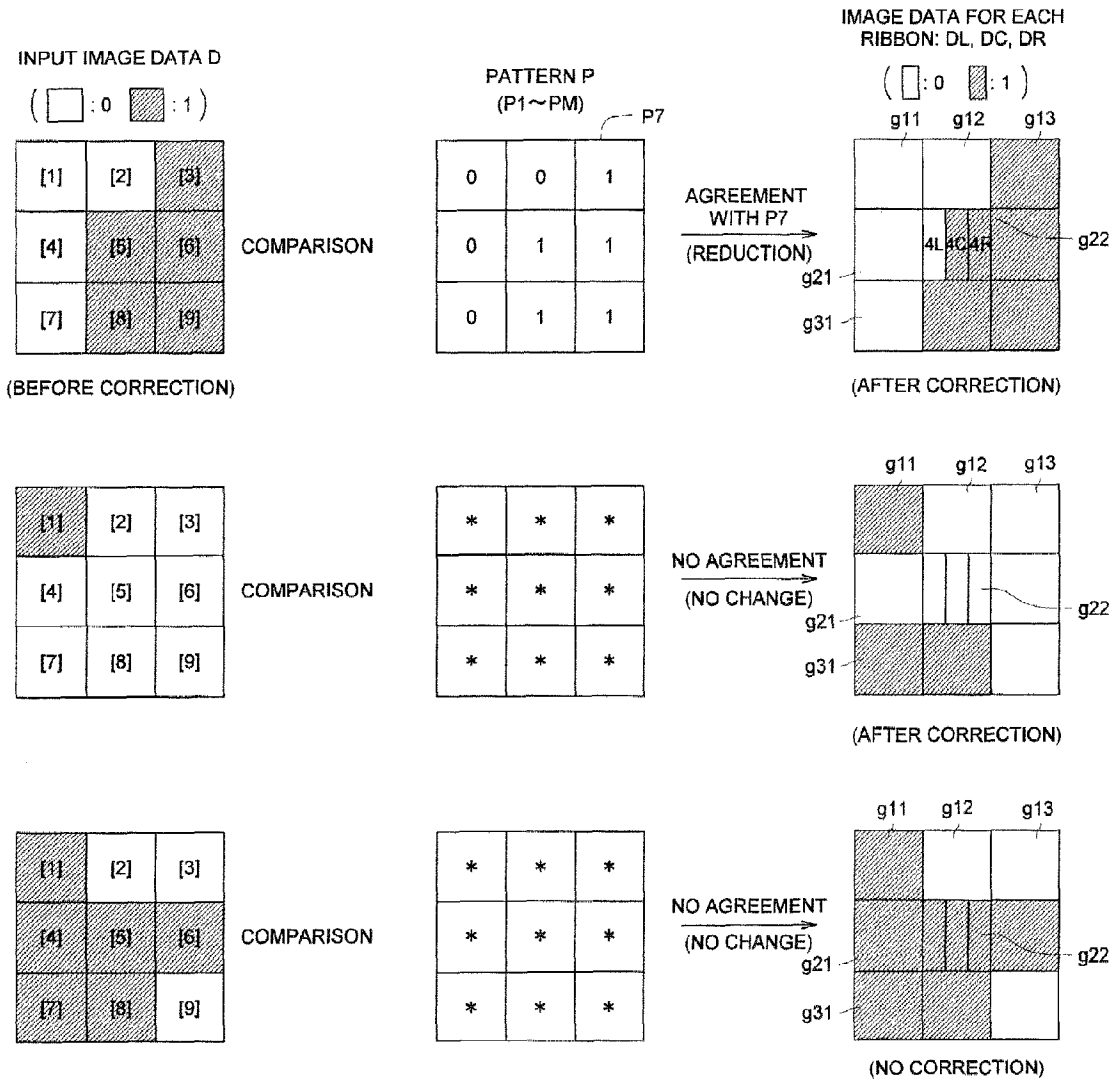
FIG. 15 ( A )
FIG. 15 ( B )
FIG. 15 ( C )

FIG. 20 ( A )
PRIOR ART
FIG. 20 ( B )
PRIOR ART
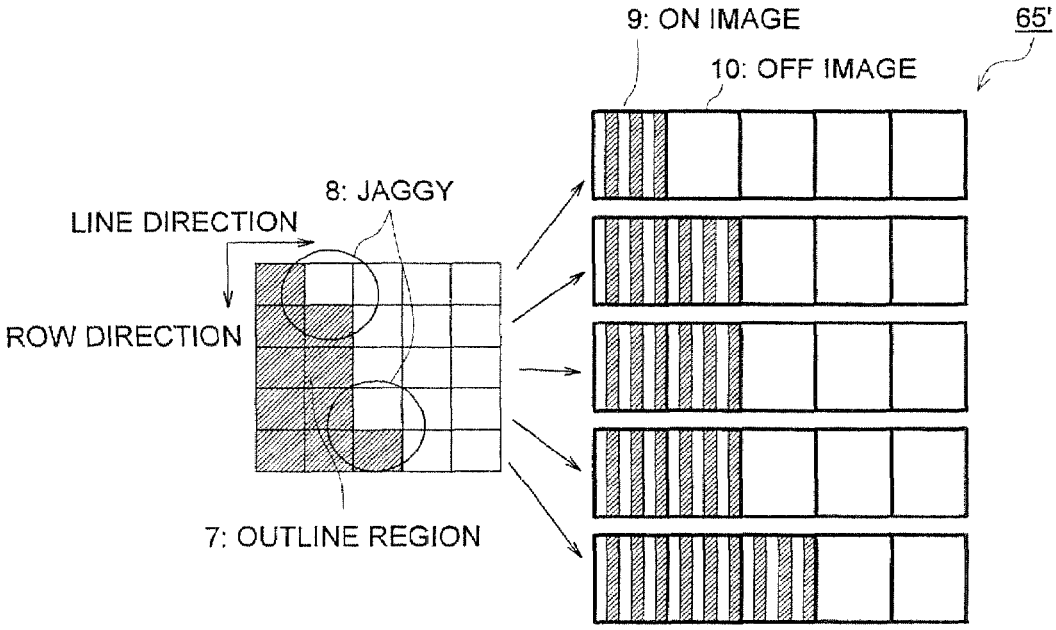

OPTICAL SIGNAL GENERATING APPARATUS, OPTICAL SIGNAL GENERATING METHOD, AND IMAGE FORMING APPARATUS

CROSS REFERENCE TO RELATED APPLICATION

The present application is a Divisional application of U.S. application Ser. No. 11/134,588 filed May 19, 2005 now abandoned, which is incorporated herein by reference and which is based on Japanese Patent Applications Nos. 2004-236682 and 2005-076008 filed with Japanese Patent Office on Aug. 16, 2004, and Mar. 16, 2005, respectively.

BACKGROUND OF THE INVENTION

1. Technical Field of the Invention

The present invention relates to optical signal generating apparatus and optical signal generating method that generate an optical signal based on image information. Further, the present invention relates to image forming apparatuses for monochrome and color printers, facsimile equipment, digital copying machines, multi-functional peripherals, etc., using the present optical signal generating apparatus and method.

2. Technical Background

Conventionally, digital copying machines that form images based on the image data of the original obtained by reading out from the original have been realized. In this type of copying machines, the image of the original is read out by a scanner etc., the original image data corresponding to that image of the original is temporarily stored in an image memory. Thereafter, the original image data read out from the image memory is subjected to image processing, and the original image data after image processing is transferred to the printer. In the printer, on a photosensitive drum charged uniformly by a charger, an electrostatic latent image is formed based on the original image data by the exposure section using a polygon mirror, etc.

This electrostatic latent image is developed by a developing unit. The toner image formed on the photosensitive drum by charging, exposure, and development is transferred to the transfer paper (or medium) by the transfer section. The toner image transferred onto the transfer paper is fixed by a fixing unit. As a result, it is possible to form an image based on the original image data on a specific transfer paper, and hence it is possible to copy the original image.

Optical signal generating apparatuses such as LED arrays or liquid crystal device arrays, diffraction grating type light valves, etc. have either been realized or have been proposed as examples of the image writing sections configuring the exposure section. In an optical signal generating apparatus of this type, light modulating elements are arranged in an array direction (typically, in the direction of the main scanning direction) corresponding to a plurality of pixels. Here, a light modulating device is the smallest unit that can be driven individually, and corresponds to each LED element in the case of an LED array or to the area of the LCD defined by one pair of electrodes in the case of a liquid crystal device array. Further, in the case of a conventional diffraction grating type of light valve, the light modulating element is in the form of three or more pairs of a fixed and movable ribbons. Even among these, the diffraction grating type light valves using fixed ribbons and movable ribbons have the advantage that they can be driven at a high speed.

Concerning diffraction grating type light valves, there has been a disclosure that the fluctuations in the optical power in DWDM communication is suppressed using the light diffraction phenomenon in the following Non-Patent Documents.

Non-Patent Document 1: "Suppressing The Fluctuations in The Optical Power in DWDM Communication Using the light diffraction phenomenon," Oishi et al, Design Wave Magazine 2002 November pp. 86-97

Non-Patent Document 2: "Overview and Applications of Grating Light Valve™ Based Optical Write Engines for High-Speed Digital Imaging," Trisnadi et al, Paper 5348-05, presented at Photonics West 2004—Micromachining and Microfabrication Symposium The GLV® (Grating Light Valve™) device described in these documents has been applied in the writing system of a copying machine provided with a high speed image writing function.

FIG. 17 is a perspective view showing a sample configuration of one pixel of the light valve 65' of the diffraction grating type in a conventional example. The light valve 65' shown in FIG. 17 can also be seen in the Non-Patent Document 1, and the longitudinal direction of the ribbon is placed along a direction (vertical direction) at right angles to the ribbon array direction. Its surface is formed as a light reflecting layer and every pixel in it comprises a plurality of fixed ribbons 3 and movable ribbons 4 for diffracting the light emitted from the light source. The light valve 65' of one pixel is configured on the silicon substrate 1 to comprise the common electrode 2, the fixed ribbons 3, and the movable ribbons 4 (electrode). The space 5 is provided between the fixed ribbons 3 and the movable ribbons 4. This space 5 is the area that generates the sagging shape of the movable ribbon 4.

FIG. 18 is a plan view showing an overall configuration of the light valve 65'. The light valve 65' shown in FIG. 18 has a length Lx in the array direction I. Its width in a direction II perpendicular to the direction I (in the vertical direction) is Wx. In this example, when three fixed ribbons 3 and three movable ribbons 4 are designed to correspond to one pixel, the light valve 65' is configured so that three pairs of fixed ribbons 3 and movable ribbons 4 are arranged for #N pixels along the line direction. Using a light valve 65' with such a #1~#N pixel configuration, the light emitted from the light source is made to be diffracted due to its diffraction phenomenon. Further, in this type of light valves, three or more pairs of fixed ribbons and movable ribbons are assigned for each pixel, and the fixed ribbons and movable ribbons within a pixel are subjected to a common drive.

FIG. 19 is a view of the top surface of the image writing section 60' configuring the exposure section in a conventional example.

In the image writing section 60' shown in FIG. 19, the laser light beam L emitted from the laser light source 63 is formed into a parallel light beam using the optical system 64 such as a collimator lens etc. The parallel light beam formed by the optical system 64 enters the light valve 65'. The light valve 65' operates so that the movable ribbon 4 is modulated based on the image data in units of a line.

At this time, when a writing voltage based on the image data is applied between the movable ribbons 4 and the common electrode 2, the movable ribbons 4 bend towards the common electrode 2 according to that voltage. When the laser light beam enters the diffraction grating with the shape of projections and depressions formed by this bent movable ribbons 4 and the fixed ribbons 3, at the pixels for which a writing voltage has been applied, a first order diffracted light is generated. At the pixels for which no writing voltage has been applied, a 0th order diffracted light is generated or reflected. The first order diffracted light L1 is diffracted with a diffraction angle θ.

In this example, the 0th order diffracted light L0 modulated in units of a line by the light valve 65' is expanded by the optical system comprising the Fourier transform (FT) lens 66*a*, the slit 67', and the inverse Fourier transform mirror 66*b* etc., and is then impinged on the photosensitive drum 71. A spot shaped opening is formed in the slit 67'. The slit 67' is placed between the FT lens 66*a* and the inverse Fourier transform mirror 66*b* and is positioned at the point where the 0th order diffracted light gets focused. The 0th order diffracted light L0 forms an image on the photosensitive drum 71. Because of this, the image data of one line is simultaneously becomes the 0th order diffracted light L0 and can be exposed (recorded) onto the photosensitive drum 71. As a consequence of this exposure, the latent electrostatic charge image is formed on the photosensitive drum simultaneously for one entire line.

An image recording apparatus using a diffraction grating type GLV® device is disclosed in Japanese Unexamined Laid-Open Patent Publication No. 2000-131628A (Page 6, FIG. 8). According to this image recording apparatus, a light modulating array that includes a diffraction grating type GLV® device is provided. The GLV® device is placed so that its longitudinal direction coincides with the longitudinal direction of the light modulating array. The longitudinal direction of the light modulating array device is made to coincide with the width direction of the rotating drum for recording. When the light modulating array is configured in this manner, it can withstand a high output laser light and it is possible to record the image at a high speed on a heat mode recording medium.

However, when the driving method of the light valve 65' such as the one shown in Non-Patent Document 1 is used, the image of a slant line is likely to be formed in a jagged manner. FIGS. 20A and 20B show an example of writing a slant line image and an example of driving the light valve 65'.

FIG. 20A is the case when three fixed ribbons 3 and three movable ribbons 4 correspond to one pixel, and is an example in which only 5 pixels in the column direction and five pixels in the row direction in a matrix are selected from the outline part 7 of the slant line image formed based on the image data. The slant line part is the black part in which the image data "1" is written. The white-on-black-background is the white part of the image in which the image data "0" is written. The border between the white part and the black part of the slant line very often becomes "jagged" and has the shape of stairs.

The "jagged" line phenomenon shown in FIG. 20A is the case when the image data corresponding to the outline part 7 of the image is written by the light valve 65' shown in FIG. 20B, and when a pixel comprising three fixed ribbons and three movable ribbons is made the black part, it is considered as the ON pixel 9 in which the writing voltage is applied to the three movable ribbons 4, and, when a pixel is made the white part, it is taken as the OFF pixel 10 in which no writing voltages are applied to the three movable ribbons 4. In other words, the three pairs of fixed ribbons 3 and movable ribbons 4 constituting a pixel are controlled so that they are driven simultaneously. In such a method, when the light valve is driven, an image with a slant line as shown in FIG. 20A will be formed in a jagged manner. In addition, the jagged line phenomenon described above is a problem that is also present in Patent Document 1. Further, this problem is also present in the usual optical signal generation apparatus having light modulating devices place in a row.

However, apart from the above, if the diffraction grating type light valve 65' that has been disclosed in Non-Patent Document 1 and in Patent Document 1 is attempted to be used as such in an image forming apparatus of a copying machine, etc., it will be necessary to install an optical system such as a Fourier transform lens 66*a*, a slit 67', and an inverse Fourier transform mirror 66*b* etc., for separating either the 0th order diffracted light L0 or the 1st order diffracted light L1. Such optical systems are both very expensive and complicated, except for the slit 67', and hinder the achievement of low cost in high speed digital copiers.

SUMMARY

In view of the above, one of the objects of the present invention is provide a novel and improved optical signal generating apparatus, optical signal generating method, and image forming apparatus.

Another object of the present invention is to provide an optical signal generating apparatus, optical signal generating method, and image forming apparatus that not only eliminates or reduces the step-shaped jagged line phenomenon but also can improve the image quality compared to the conventional methods.

Further, still another object of the present invention is to provide an information recording apparatus, information recording method, and image forming apparatus in which it is made possible to shut off (remove) easily the diffracted light components not required for recording image information without depending on the Fourier transform optical system etc., by modifying the placement of the ribbons in a diffraction grating type light valve.

These purposes are achieved by structures having the following aspects of the present embodiments.

(1) An information recording apparatus that records image information on an image forming body, and comprises a light source, a diffraction grating type light valve that has a plurality of ribbons and that modulates the light emitted from said light source according to said image information, and an optical device that forms the image on said image forming body from the diffracted light modulated by said light valve, and said light valve is placed so that the longitudinal direction of said ribbons is at a specific angle with respect to a direction at right angles to the array direction of said ribbons.

(2) An information recording method of recording image information on an image forming body using a diffraction grating type light valve that has a plurality of ribbons, and comprises a process of emitting light on said light valve placed so that the longitudinal direction of said ribbons is at a specific angle with respect to a direction at right angles to the array direction of said ribbons, a process of modulating the light impinging on said light valve according to said image information of the corresponding line, and a process of recording the information by forming an image on said image forming body selectively from the diffracted light modulated by said light valve.

(3) An image forming apparatus with the feature that it comprises an image forming body, an information recording section that records electrostatic latent image on said image forming body, and an image forming section that forms an image by converting into visible form the electrostatic latent image recorded on said image forming body by said information recording section, wherein said information recording section comprises a light source, a diffraction grating type light valve that has a plurality of ribbons and that modulates the light emitted from said light source according to said image information, and an optical device that forms the image on said image forming body from the diffracted light modulated by said light valve, and said light valve is placed so that the longitudinal direction of said ribbons is at a specific angle with respect to a direction at right angles to the array direction of said ribbons.

(4) A light modulating apparatus with the feature that the apparatus is provided with a light source, a diffraction grating type light valve for modulating the light emitted from this light source in accordance with the image information in which N sets of ribbon pairs configured to have plural numbers of fixed and movable ribbons per pixel are arranged in parallel, and a control section that drives independently each pair of fixed and movable ribbons.

(5) An optical signal generating method of modulating the light using a diffraction grating type light valve in which N sets of ribbon pairs configured to have plural numbers of fixed and movable ribbons per pixel are arranged in parallel, and has the feature that it comprises a step for exposing light on the light valve, and a step of modulating the exposed light by independently driving each pair of fixed and movable ribbons based on the image information.

(6) An image forming apparatus is provided with an image forming body, an information recording section that records an electrostatic latent image on this image forming body, and an image forming section that forms the image by converting to a visible image the electrostatic latent image recorded on the image forming body by this information recording section, with the information recording section having the light modulating apparatus specified in item (4) above, and an optical system that forms the image on the image forming body using the diffracted light modulated by the light valve of this optical modulator.

(7) The optical signal generating apparatus that generates an optical signal based on the image information, and has the feature that it comprises an optical signal generator in which the optical modulators are placed in the form of an array for a plural number of pixels with each pixel having a plural number of optical modulators, a control section that independently drives each optical modulator in the optical signal generator, and this control section executes outline recognition processing based on the image information, and based on this outline recognition processing, a judgment is made as to whether or not it is necessary to carry out the outline correction processing of increasing or decreasing the width of the pixel in said array direction.

(8) An optical signal generating method of generating an optical signal based on the image information, and has a step of generating an optical signal using an optical signal generator in which optical modulators are placed in the form of an array for a plural number of pixels with each pixel having a plural number of optical modulators, and this optical signal generating method comprises a step of carrying out outline recognition processing based on the image information, and a step of carrying out judgment, based on this outline recognition processing, as to whether or not it is necessary to carry out the outline correction processing of increasing or decreasing the width of the pixel in said array direction.

BRIEF DESCRIPTION OF THE DRAWINGS

These and other objects, advantages and features of the invention will become apparent from the following description thereof taken in conjunction with the accompanying drawings in which:

FIGS. 7(A) and 7(B) are front views showing the size of the slit 67 and an example of its function;

FIGS. 13(A) to 13(H) are diagrams showing examples of the relationships between the pattern data Pi [j] and the image data for each of the ribbons (DL, DC, DR);

FIGS. 14(A) to 14(C) are diagrams showing examples of smoothing processing (Part 1) in the image processing section 21;

FIGS. 15(A) to 15(C) are diagrams showing examples of smoothing processing (Part 2) in the image processing section 21;

FIGS. 20(A) and 20(B) are diagrams showing an example of writing a slant line image and an example of driving the light valve 65'.

DETAILED DESCRIPTION OF THE PREFERRED EMBODIMENT

In the following, the optical signal generating apparatus, the optical signal generating method, and the image forming apparatus according to a preferred embodiment of the present invention are described while referring to the attached drawings.

Figure 1:
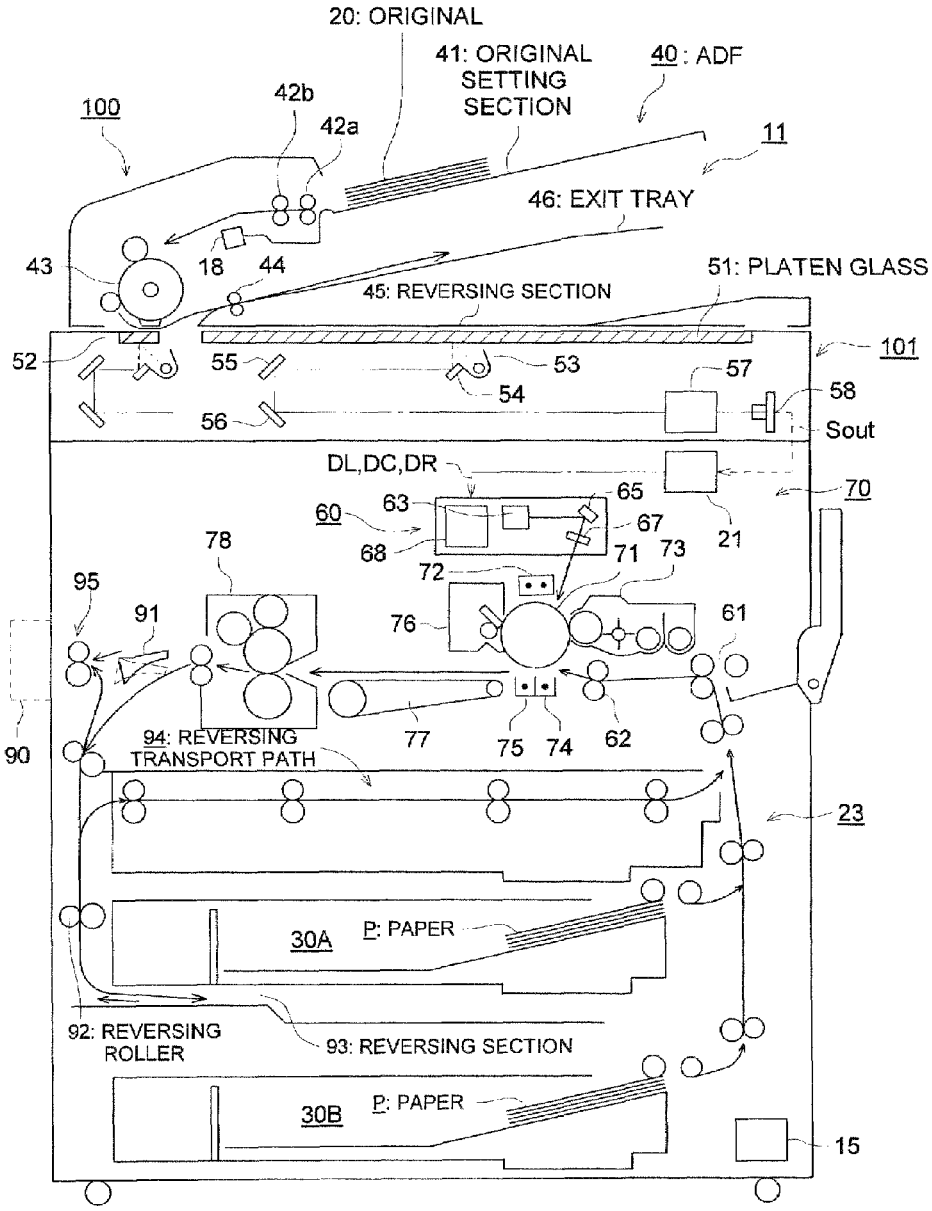
FIG. 1 is a conceptual outline diagram showing an example of configuration of a high speed digital copying machine 100 using an optical signal generating apparatus in a preferred embodiment of the present invention.

The high speed digital copying machine 100 (referred to hereinafter merely as the copying machine) for monochrome reproduction shown in FIG. 1 is an example of the image forming apparatus, and is an apparatus that carries out smoothing operations on the image information obtained by reading the original document 20, forms the electrostatic latent image on the photosensitive drum 71 based on the image data DR, DC, and DL after this processing, and forms the image by converting this electrostatic latent image into a visible image. The copying machine 100 comprises the copying machine main unit 101.

The original document reading section 11 constituting a scanner is provided in the copying machine main unit 101, and the control section 15, paper feed trays 30A and 30B, the image writing section 60, the image forming section 70 etc., are provided within the copying machine main unit 101. The original document reading section 11 has an automatic document feeder unit (hereinafter referred to as ADF) 40 which not only feeds automatically the original document 20 but also operates so that the original document is read out and the original document read out signal Sout is output.

ADF 40 is installed on the top part of the copying machine main unit. ADF 40 comprises a original setting section 41, roller 42*a*, roller 42*b*, roller 43, transport roller 44, and document discharge tray 46. One or more sheets of the original document 20 are loaded in the original setting section 41 mentioned above. The roller 42*a* and roller 42*b* are provided on the downstream side of the above original setting section 41, and when the automatic document feed mode has been selected, the documents 20 sent out from the original setting section 41 are transported so that they are rotated in a U-turn manner by the roller 43 on the downstream side. The original document 20 is read out and the original document read out signal Sout is output when the original document 20 is being rotated in a U-turn manner by the roller 43 in the original document reading section 11. The original document 20 is transported by the transport roller 44 and is discharged to the original document discharge tray 46.

Further, the first platen glass 51, the second platen glass (ADF glass) 52, the light source 53, mirrors 54, 55, and 56, the imaging optical section 57, the CCD photographing device 58, and optical drive section not shown in the figure are provided in the copying machine main unit. During the flat bed scanning mode, the original document 20 placed on the first plate glass is read out. For example, the optical drive section scans the light source 53 and the mirror 54. The light from the light source 53 that illuminates the original document 20 is reflected as the read out light from that original document 20. The read out light is focused as the image by the imaging optical section 57 after being reflected by the mirrors 54 to 56, and is read out by the CCD photographing device 58. The CCD photographing device 58 is composed of a reduced size image sensor. The image processing section 21 is connected to the output of the CCD photographing device 58 and carries out binary value digitization processing of the analog original document read out signal Sout, subsequently carried out outline correction processing, and thereafter the image data DR, DC, and DL in units of a line after this processing is output to the image forming section 70.

The image forming section 70 comprises the image writing section 60, the organic photosensitive drum (hereinafter referred to merely as the photosensitive drum) 71, the charging unit 72, the developing unit 73, the image transferring unit 74, the separating unit 75, the cleaning apparatus 76, the transporting mechanism 77, and the fixing unit 78. The image forming section 70 forms the image by converting the electrostatic image recorded by the image writing section 60 on the photosensitive drum 71 into a visible image, and the image is transferred onto a specific transfer paper (referred to hereinafter as the paper) P. In this example, the charging unit 72 is placed above the photosensitive drum 71, and the photosensitive drum is charged beforehand to a specific charging potential uniformly. A scorotron charging unit is used as the charging unit 72.

The image writing section 60, which is an example of the image recording apparatus, is placed, for example, to the right side above the photosensitive drum 71, and the image information is recorded on the photosensitive drum 71. The image writing section 60 is configured to comprise the laser light source 63, the diffraction grating type light valve 65 as an optical signal generator, the slit 67, and the valve drive circuit 68. Blue, red, and green colored semiconductor lasers etc. that radiate laser beams of specific wavelengths are used as the laser light source.

In the image writing section 60, the light emitted from the laser light source 63 is modulated by the diffraction grating type light valve 65 based on the image data DR, DC, and DL output in units of a line after outline correction processing from the image processing section 21 (see FIG. 2 to FIG. 6). This diffracted light modulated by the light valve in units of a line and having a specific energy is converted into an image on the photosensitive drum 71 by the optical system that includes the slit 67. This diffracted light simultaneously exposes the data of one line on the photosensitive drum 71. As a result of this exposure, one line of the electrostatic latent image is formed on the photosensitive drum 71.

Further, the developing unit 73 having the toner and the carrier (the developing material) is placed on the right side of the photosensitive drum 71, and the electrostatic latent image formed due to the light exposure by the image writing section 60 is developed by the toner material. On the lower side of this developing unit 73 is provided the paper feeding section 30 configured to comprise the registration roller 62 and the paper feeding trays 30A and 30B etc. The paper stored inside the paper feeding trays 30A and 30B is fed by the sending roller and the paper feeding roller not shown in the figure but provided respectively in these paper feeding trays 30A and 30B, and is transported to the underside of the photosensitive drum 71 after passing through the transport roller 61, the registration roller 62 etc.

The image transferring unit 74 is provided below the photosensitive drum 71, and the toner image formed on the photosensitive drum 71 due to charging, exposure, and development is transferred onto the paper P by the registration roller with the transportation timing of the paper being controlled. The separating unit 75 is provided adjacent to this image transferring unit 74 and separates the paper P onto which the toner image has been transferred from the photosensitive drum 71.

The paper transporting mechanism 77 is provided on the downstream side of this separating unit 75, and the fixing unit 78 is provided at the other end of this paper transporting mechanism 77. The toner image transferred onto the paper P is fixed thermally in the fixing unit 78. The paper P after the fixing process is clasped by the paper discharge roller 95 and is discharged to the paper discharge tray etc. outside the copying machine. When an image is to be formed on the reverse side of the paper, the paper discharge path is branched by the branching section 91 and the paper P after the fixing process is guided into the reversing section 93 by the reversing roller 92, passed through the reversing transport path 94, and is then sent to the registration roller 62. The paper P after having an image transferred onto its reverse side also is discharged to the paper discharge tray. The paper P on which the image formation has been completed need not be sent directly to the paper discharge tray but may be subjected to stapling or stitching by the finisher unit 90.

The cleaning unit 76 is provided opposite the photosensitive drum 71 and between the transporting mechanism 77 and the charging unit 72 described above, and the toner remaining on the photosensitive drum 71 is cleaned. The next copying cycle is entered thereafter. During the formation of these images, it is desirable that thin paper of 52.3~63.9 kg/m$^2$ (1000 sheets) grade, or regular paper of 64.0~81.4 kg/m$^2$ (1000 sheets) grade, thick paper of 83.0~130.0 kg/m$^2$ (1000 sheets) grade, or very thick paper of 150.0 kg/m$^2$ (1000 sheets) is used as the paper P, the line speed is set at about 80~350 mm/sec, and the environmental conditions are a temperature in the range of 5°~35° C. and a relative humidity of 15~85%. The thickness of the paper P used is about 0.05~0.15 mm.

Figure 2:
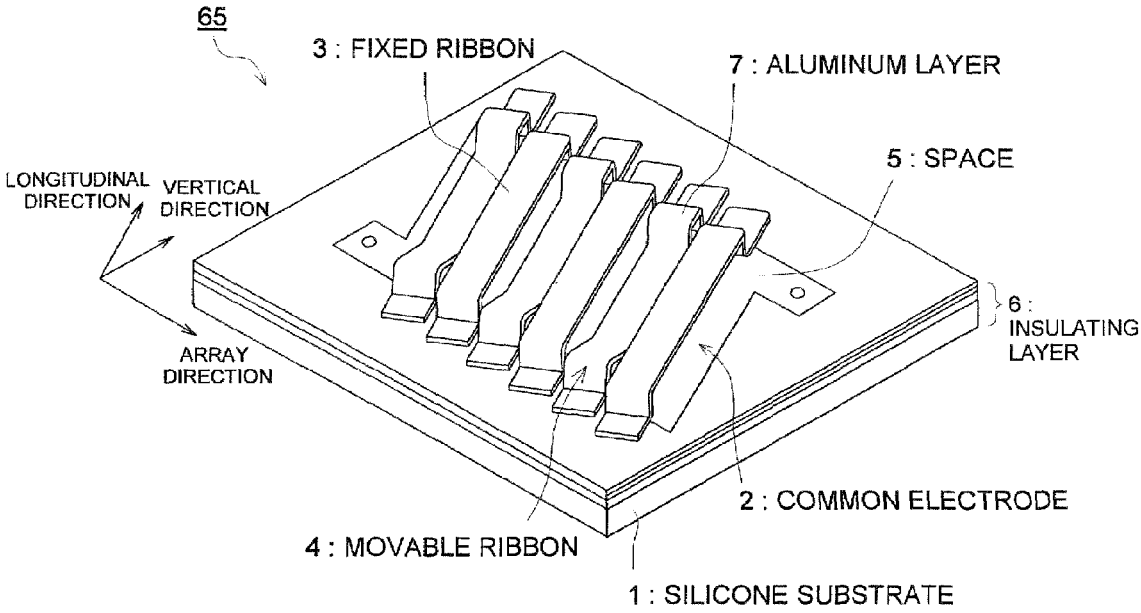
FIG. 2 is a perspective view showing an example of the configuration for one pixel of the diffraction grating type light valve 65.

FIG. 2 is a perspective view showing an example of the configuration for one pixel of the diffraction grating type light valve 65. In this example, the light valve 65 for diffracting (modulating) the light emitted from the laser light source 63 shown in FIG. 1 has N sets of ribbon pairs configured to have plural numbers of fixed ribbons 3 and movable ribbons 4 per pixel that are arranged in parallel. In this example, the description given here is for the case when the number of pairs is three. The light valve for one pixel shown in FIG. 2 is configured by providing the common electrode 2, the fixed ribbons 3, and the movable ribbons (electrodes) 4 on a silicon substrate 1. The fixed ribbons 3 and the movable ribbons 4 are placed alternately over the common electrode 2.

Here, when the direction of the array of the fixed ribbons 3 and the movable ribbons 4 is taken as I, the direction at right angles to this array direction I is taken as II, and the longitudinal direction of these fixed ribbons 3 and the movable ribbons 4 is taken as III, the placement is made such that the longitudinal direction III of these fixed ribbons 3 and the movable ribbons 4 has a specific angle ϕ with the direction II at right angles to the array direction of the ribbons 3 and 4. This is for rotating the diffracted light components of the light modulated by the fixed ribbons 3 and movable ribbons 4 around the 0th order light as the axis.

A silicon dioxide film with a film thickness of about 5000 Å forming the device insulation layer 6 is formed on the silicon substrate 1. A poly-silicon oxide film with a film thickness of about 3000 Å constituting the common electrode (ground plane) 2 is formed on a specific area of the device insulating layer 6. On its surface is formed again a silicon dioxide film, though not shown in the figure, with a thickness of about 200 Å and constituting an insulating protective layer. On the insulating protective layer are formed the fixed ribbons 3 and the movable ribbons 4 constituted by silicon nitride oxide films with a film thickness of about 800 Å at positions crossing the common electrode 2 so that they are in the shape of a bridge over the common electrode 2. In addition, the fixed ribbons 3 and the movable ribbons 4 are placed so that they are at an inclined angle ϕ with the direction II at right angles to the array direction I of these ribbons 3 and 4.

The space 5 is provided between the fixed ribbons 3 and the movable ribbons 4. This space 5 is the region generating the sagging shape of the movable ribbons 4. The surfaces of the fixed ribbons 3 and the movable ribbons 4 are made to have a mirror finish in order to increase the reflectivity by evaporating on to their surfaces an aluminum film with a film thickness of about 500 Å.

In this example, each pixel has a configuration of three fixed ribbons 3 and three movable ribbons 4. Of course, it is not necessary to restrict only to the case of constituting one pixel with six ribbons, and it is also possible to constitute each pixel with eight ribbons or 12 ribbons. As the number of ribbons per pixel is increased, it is possible to form images with higher gradations.

Figure 3:
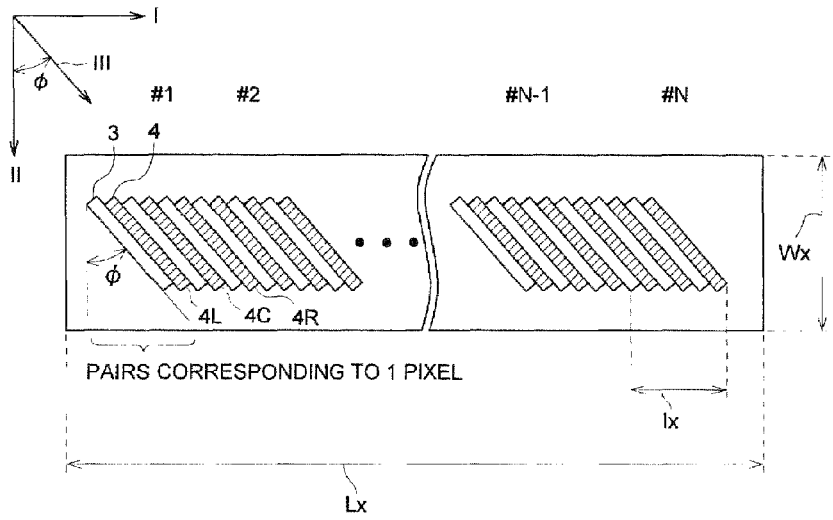
FIG. 3 is a plan view showing an example of the overall configuration of the light valve 65.

FIG. 3 is a plan view showing an example of the overall configuration of the light valve 65. In this example, the light valve 65 is placed such that the longitudinal direction of the fixed ribbons 3 and the movable ribbons 4 has a specific angle ϕ with the direction at right angles to the array direction of these ribbons 3 and 4. In the light valve 65 shown in FIG. 3, the length in the array direction (the line direction) I is Lx. The width in the direction II at right angles to it (the vertical direction) is Wx.

This is an example in which three fixed ribbons 3 and three movable ribbons 4 having an inclination angle of ϕ correspond to one pixel, and the light valve 65 is configured by arranging three pairs of fixed ribbons 3 and movable ribbons 4 along the line direction I for #N pixels with an inclination angle of ϕ. For example, when the resolution for a paper size of A4 (corresponding to a length of 297 mm in the vertical direction) is 600 dpi, #N is 7020 pixels. The length lx of each pixel is about 30 μm to 40 μm.

The laser light emitted from the laser light source 63 is diffracted using such a light valve with a configuration of #1~#N pixels due to its diffraction phenomenon. In this example, although the fixed ribbons 3 and the movable ribbons 4 have been placed so that they are slanting downward to the right side, it is not necessary to limit the placement to this, but of course it is also possible to place the fixed ribbons 3 and the movable ribbons 4 so that they are slanting downward to the left side. In either case the diffracted light components get rotated. In the following discussions, among the three movable ribbons 4 of each pixel, the movable ribbon at the center of the three ribbons is referred to as the center movable ribbon 4C, the movable ribbon to its left is referred to as the left movable ribbon 4L, and the movable ribbon to the right of the center movable ribbon is referred to as the right movable ribbon 4R with each of them being denoted by subordinate symbols in this manner.

Figure 4:
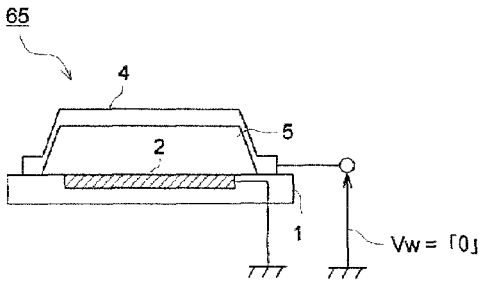
FIGS. 4(A) and 4(B) are cross-sectional view diagrams in the width direction showing an example of the movement of the left movable ribbon 4L in the light valve 65.
Figure 4:
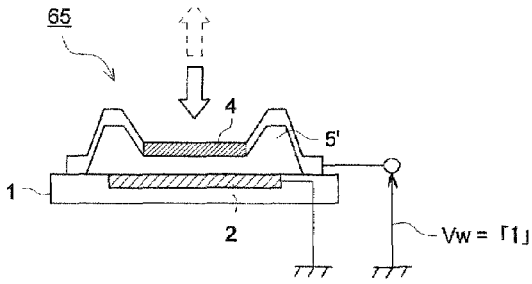

FIGS. 4 (A) and 4 (B) are cross-sectional view diagrams in the width direction showing an example of the movement of the left movable ribbon 4L in the light valve 65. In the light valve 65 in this example, a writing voltage Vw corresponding to the image data DL for one line after outline correction processing is being applied between the common electrode 2 and the left movable ribbon 4L at every ⅓ pixels. The example shown in FIG. 4 (A) is the situation when the writing voltage Vw="0" between the common electrode 2 and the left movable ribbon 4L, that is, when no writing voltage Vw is being applied. When this applied voltage is OFF, the left movable ribbon 4L and the fixed ribbon 3 not shown in the diagram are in a state in which their heights are identical. As a result of this, the space 5 is generated between the left movable 4L or the fixed ribbon 3 and the common electrode 2.

Furthermore, the example shown in the light valve 65 in FIG. 4 (B) is the situation when the writing voltage Vw="1" between the common electrode 2 and the left movable ribbon 4L, that is, when a writing voltage Vw is being applied. When this applied voltage is ON, the left movable ribbon 4L gets bent and goes into a sagging shape and the height of the left movable ribbon 4L becomes lower than the height of the fixed ribbon 3 not shown in the figure.

It is possible to make the deformation of the left movable ribbon 4L a maximum at the ¼ of the wavelength λ of the incident light. For example, when the wavelength λ of the incident light is 1540 nm, the corresponding amount of sag is about 385 nm to 395 nm. The writing voltage Vw in order to obtain this amount of sag is, for example, approximately Vw=15V to 20V.

When the above writing voltage is applied the space 5 between the common electrode 2 and the left movable ribbon 4L changes to the space 5'. This sagging of the left movable ribbon 4L is generated because the left movable ribbon 4L gets depressed and goes closer to the common electrode due to the electric suction force generated between them thereby displacing its height position. As a result of this depression of the movable ribbon, the fixed ribbon 3 and the left movable ribbon 4L form a corrugated shape thereby configuring a diffraction grating. By irradiating the diffraction grating constituted based on the corrugated shape formed by the fixed ribbon 3 and the left movable ribbon 4L with a beam of laser light from the laser light source 63, it is possible to modulate (diffract) that laser light beam.

Further, among the other movable ribbons, the central movable ribbon 4C is operated in a similar manner by a writing voltage Vw corresponding to the image data DC for one line after outline correction processing, and the right movable ribbon 4R is operated in a similar manner by a writing voltage Vw corresponding to the image data DR for one line after outline correction processing. Their explanation will be omitted here.

Figure 5:
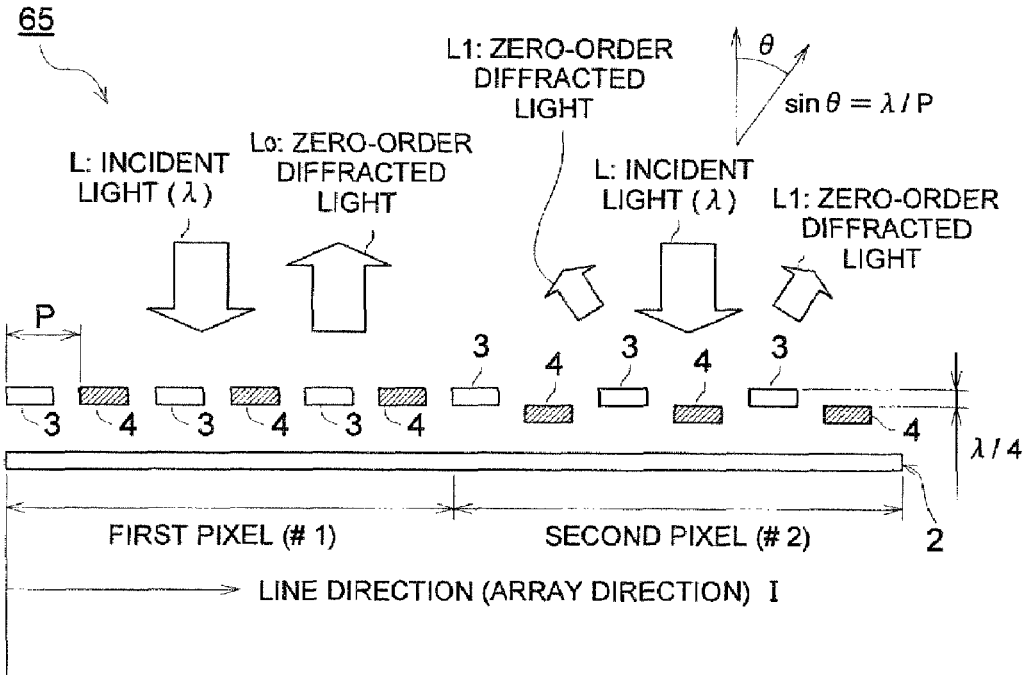
FIG. 5 is a cross-sectional view diagram in the array direction I showing an example of operation of two pixels in the light valve 65.

FIG. 5 is a cross-sectional view diagram in the array direction I showing an example of operation of two pixels in the light valve 65. In this example, attention is given to two neighboring pixels in the array direction I of the light valve 65, and these pixels of interest are referred to as the first pixel #1 and the second pixel #2.

The first pixel shown in FIG. 5 is in the OFF state. In this state, no writing voltage has been applied to the left movable ribbon 4L, the central movable ribbon 4C, and the right movable ribbon 4R of the first pixel #1, that is, the applied voltage is in the "OFF" state. In this case, the laser beam L of wavelength λ incident on the first pixel #1 (referred to hereinafter the incident beam) is reflected fully by the three fixed ribbons 3, the left movable ribbon 4L, the central movable ribbon 4C, and the right movable ribbon 4R. This reflected light is the 0th order diffracted light L0.

Further, the second pixel #2 adjacent to the first pixel #1 is in the ON state. In this state, writing voltages have been applied to the left movable ribbon 4L, the central movable ribbon 4C, and the right movable ribbon 4R of the second pixel #2, that is, the applied voltage is in the "ON" state. In this case, the laser beam L of wavelength λ incident on the second pixel #2 (referred to hereinafter the incident beam) is diffracted by the three fixed ribbons 3, the left movable ribbon 4L, the central movable ribbon 4C, and the right movable ribbon 4R. This diffracted light is the 1st order diffracted light L1.

The difference described above in the heights of the left movable ribbon etc. and the fixed ribbon, that is, the amount of sagging displacement, is equal to λ/4 of the incident light beam. Here, taking the angle between the 0th order diffracted light L0 and the 1st order diffracted light L1 as the diffraction angle θ, the wavelength of the laser beam L as λ, the pitch of placement of the fixed ribbons and of the movable ribbons as P, the relationship $\sin\theta=\lambda/P$ will be satisfied between these three quantities.

In this example, in addition to the function described above, it has been made possible to carry out the ON/OFF control of the applied writing voltage Vw based on the image data DL, DC, and DR of one line after smoothing processing for each of the movable ribbons 4L, 4C, and 4R, as has been described in the explanation for FIG. 4. For example, it is possible to apply a writing voltage Vw based on the image data DR of one line after smoothing processing to the right movable ribbon 4R of the first pixel #1 while switching OFF the writing voltages for the remaining movable ribbons in the first pixel #1, that is for the central movable ribbon 4C and the left movable ribbon 4L. In this example, the function described above is used for carrying out outline correction processing. This outline correction processing is the processing of increasing or decreasing the width of the target pixel in the image of a slant line or curved line formed by the image data $D_{IN}$. This processing is referred to as the smoothing processing in the following descriptions.

Because of this, it is possible to modulate as well as to carry out smoothing processing of the laser light L emitted from the laser light source 63 based on the image data DL, DC, and DR of one line after smoothing processing output by the image processing section 21 using the light valve 65.

Figure 6:
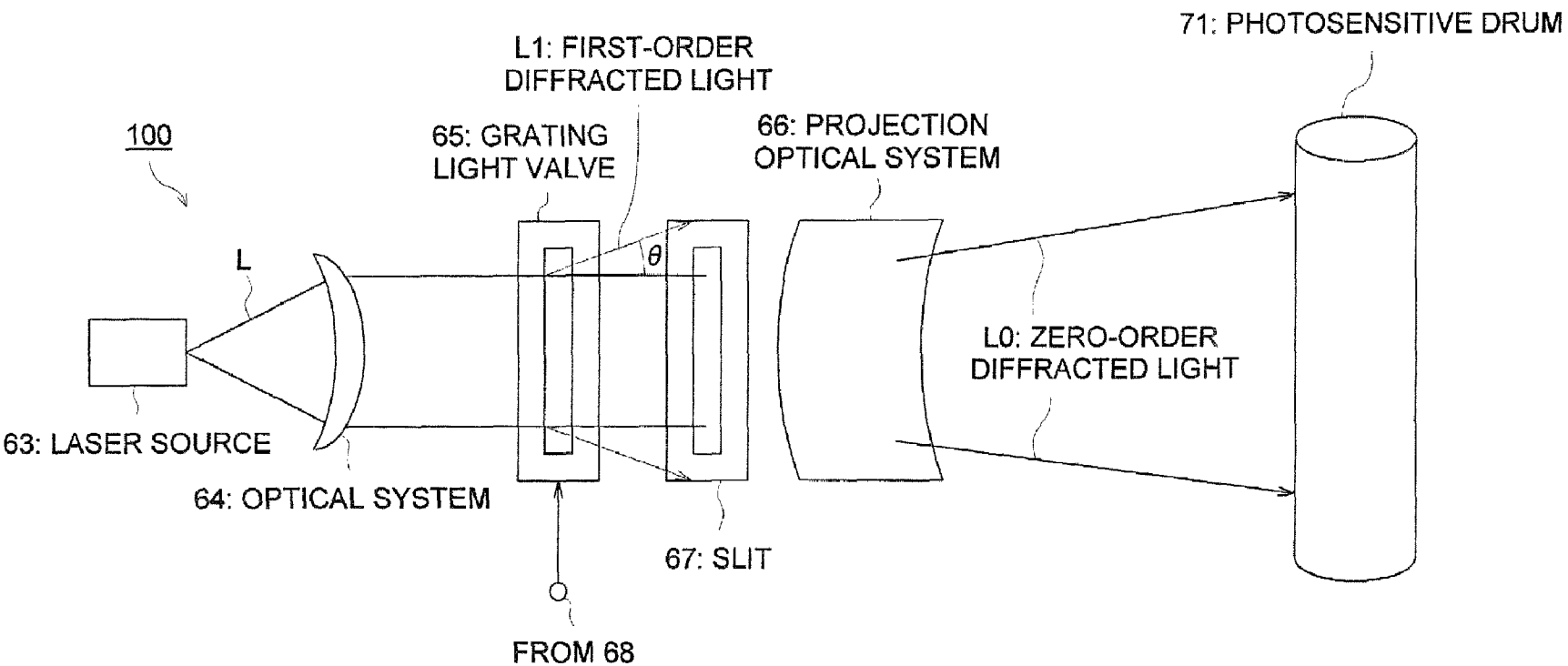
FIG. 6 is a top view showing the principle of exposure in the image writing section 60 of the copying machine 100.

FIG. 6 is a top view showing the principle of exposure in the image writing section 60 of the copying machine 100. In this example, a slit 67 is placed between the light valve 65 and the projection optical system 66. The slit 67 has an opening section 67*a* in the longitudinal direction, and the slit is placed so that the longitudinal direction of that opening section 67*a* is parallel to the longitudinal direction of the photosensitive drum 71.

In the image writing section 60 shown in FIG. 6, the laser light beam L emitted from the laser light source 63 is converted into a parallel beam of light by the optical system 64 such as a collimator lens etc. The parallel beam of light formed by the optical system 64 is made to incident upon the light valve 65. The light valve 65 operates in a manner explained in the descriptions for FIGS. 2 to 5 so as to modulate the left movable ribbon 4L, the central movable ribbon 4C, and the right movable ribbon 4R based on the image data DL, DC, and DR of one line after smoothing processing. At this time, although the 1st order diffracted light L1 is diffracted with a diffraction angle of θ, the 1st order diffracted light component will remain in the 0th order diffracted light L0.

Furthermore, the 0th order diffracted light L0 has its optical axis rotated by an angle of only φ compared to the light valve 65' according to the conventional method, passes through the slit 67, and is incident on the projection optical system (optical section) 66. In other words, the 0th order diffracted light L0 having a specific energy and corresponding to one line and modulated by the light valve 65 has its 1st order diffracted light component cut off in the slit 67, and thereafter, is expanded by the projection optical system 66 and is projected onto the photosensitive drum 71. The 0th order diffracted light L0 forms an image on the photosensitive drum 71. Because of this, it is possible to expose (record) on the photosensitive drum 71 using the 0th order diffracted light L0 one line of image data after smoothing processing DL, DC, and DR simultaneously. As a result of this exposure, the electrostatic latent image of one line is formed simultaneously on the photosensitive drum 71. Further, although in this example the explanation has been given for the case when the image data DL, DC, and DR are exposed by irradiating the photosensitive drum 71 with the 0th order diffracted light component L0, it is not necessary to limit to this, but it is also possible to use the 1st order diffracted light L1 for recording.

FIGS. 7 (A) and (B) are front views showing the size of the slit 67 and an example of its function.

The slit 67 shown in FIG. 7 (A) is placed between the light valve 65 and the projection optical system 66. The slit 67 has a length L [mm] along the longitudinal direction, and its width in the shorter edge direction is W [mm]. This slit 67 is provided with an opening section 67*a* so that the 0th order diffracted light L0 can pass through it. The length of the opening section 67*a* in the longitudinal direction is l [mm] and its width in the shorter edge direction is w [mm]. Metallic materials or hardened plastic materials are used for the slight 67. For example, an iron plate having a size of L×W and having an opening section 67*a* cut in it can be used as the slit 67, or else, an aluminum plate of the same size and having an opening section 67*a* cut in it can also be used as the slit 67.

In this example, the placement is such that the longitudinal direction of the opening section 67*a* of the slit 67 shown in FIG. 7 (B) is parallel to the longitudinal direction of the photosensitive drum 71 shown in FIG. 6. The 0th order diffracted light L0 having a specific energy and corresponding to one line and modulated by the light valve 65 passes through the slit 67. Only its 1st order diffracted light component can be shut off by this slit 67.

However, in the case of the conventional light valve in which the longitudinal direction of the ribbons is placed to be parallel to the direction at right angles to the array direction of those ribbons ($\phi=0°$), the 1st order diffracted light component will be present in a direction at an angle of $\phi=0°$ with respect to the longitudinal direction of the opening section 67*a* of the slit 67. As a result, since the 1st order diffracted light components L1 will be present on both sides of the 0th order diffracted light L0 along the longitudinal direction, even these 1st order diffracted light components will pass through the slit 67 along with the 0th order diffracted light L0.

In contrast with this, in the configuration according to the present preferred embodiment of the present invention, a light valve is provided in which the longitudinal direction of the ribbons is at an angle $\phi$ to the direction at right angles to the array direction of those ribbons, and also, the slit 67 is placed (position adjusted) at a location at which the width w of the its opening section 67*a* has the same size as the beam diameter of the 0th order diffracted light L0. As a result of this, the 1st order diffracted light components will be present in a direction at an angle $\phi$ to the longitudinal direction of the opening section 67*a*, and hence it will be possible to let pass through the slit 67 only the 0th order diffracted light L0.

In this example, as is shown in FIG. 3, when the fixed ribbons 3 and the movable ribbons 4L, 4C, and 4R have been placed so that they are slanting downward to the right side, and even when the fixed ribbons 3 and the movable ribbons 4L, 4C, and 4R have been placed so that they are slanting downward to the left side, if the minimum angle at which the light can be cut off is taken as $\phi x$, it is possible to cut off the 0th order diffracted light L0 in the range of $\phi x \leqq \phi < 90°$.

Figure 8:
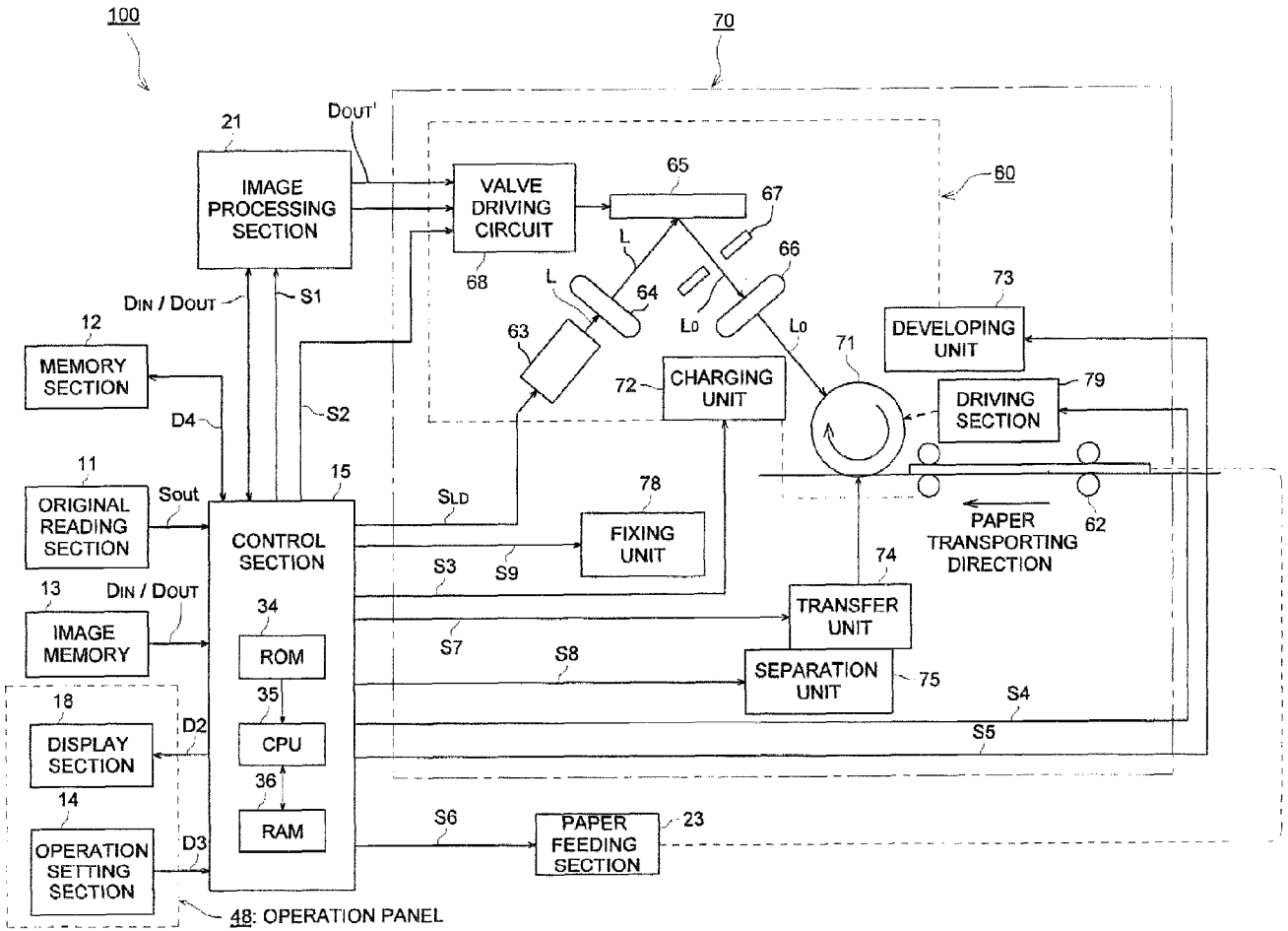
FIG. 8 is a block diagram showing an example of the configuration of the control system of the copying machine 100.

FIG. 8 is a block diagram showing an example of the configuration of the control system of the copying machine 100. The copying machine 100 shown in FIG. 8 is configured to comprise an original document reading section 11, a memory section 12, an image memory 13, a control section 15, an image processing section 21, a paper feeding section 30, an operation panel 48, and an image forming section 70.

The control section 15 comprises a ROM (Read Only Memory) 34, a CPU (Central Processing Unit) 35, and a RAM (Random Access Memory) 36. System programs for controlling that entire copying machine are stored in the ROM 34. RAM 36 is used as the working area memory, and stores, for example, control commands etc., temporarily. When the power supply to the copying machine is switched ON, the CPU 35 reads out the system program and data from the ROM 34 and stores them in the PAM 36 and starts the system operations and thereafter controls the entire copying machine based on the operation data D3 output from the operation panel 48.

For example, the CPU 35 carries out the input and output control of the original document reading section 11, the memory section 12, the image memory 13, the image processing section 21, the paper feeding section 30, and the image forming section 70, based on the operation data D3 input from the operation panel 48. In this example, the CPU 35 control the light valve 65 through the image processing section 21 so as to drive in units of one pairs of ribbons such as the fixed ribbon 3 and the left ribbon 4L, the fixed ribbon 3 and the central ribbon 4C, or the fixed ribbon 3 and the right ribbon 4R, etc. For example, in the image processing section 21, the image formed based on the image data $D_{IN}$ is expanded beforehand in the RAM 36 or in the working storage area not shown in the figure and carries out outline recognition processing (hereinafter referred to as pattern recognition processing), and based on this pattern recognition processing, judges whether or not to carry out smoothing processing. This judgment is made by computing after inputting the necessary data to the logic circuits. The smoothing processing involves of increasing or decreasing the width of the target pixel constituting an inclined line or a curved line.

When the result of this judgment is that smoothing processing is "Necessary" and when it is judged that the widths of these pixels is to be increased, the image processing section adds the drive control of the pair of ribbons comprising the fixed ribbon 3 and the left movable ribbon 4L or the right movable ribbon 4R that is nearest to the boundary between the target pixel and its neighboring pixels. In addition, when it is judged that the widths of these pixels is to be decreased, the image processing section deletes the drive control of the pair of ribbons comprising the fixed ribbon 3 and the left movable ribbon 4L or the right movable ribbon 4R that is nearest to the boundary between the target pixel and its neighboring pixels. In this manner, through the image processing section 21, the CPU 35 controls the writing to the light valve 65 so as to select the combination within a pixel of the fixed ribbon 3 and the left movable ribbon 4L, the central movable ribbon 4C, or the right movable ribbon 4R.

The original document reading section 11 is connected to the control section 15, and reads out the original document 20 and outputs the original document read out signal Sout to the control section 15. The control section 15 carries out analog to digital (A/D) conversion of the original document read out signal Sout and transfers the original document image data $D_{IN}$ to the image memory 13. The image memory 13 temporarily stores the original document image data $D_{IN}$, and outputs the original image data $D_{OUT}$ ($=D_{IN}$) to the image processing section 21 under read out control of the control section 15. The original document image data $D_{IN}$ is input to the image processing section 21. A hard disk drive (HDD) or a DRAM etc. is used as the image memory 13.

The image processing section 21 is connected to the control section 15, and carries out the encoding and compression processing and the decoding and expansion processing, and the smoothing processing etc., of the original document image data $D_{IN}$ based on the image processing signal S1. These image data DL, DC, and DR after image processing are output to the image forming section 70. The image forming section 70 comprises the image writing section 60, the developing unit 73, the image transferring unit 74, the separating unit 75, and the fixing unit 78, etc., and forms the image on the specific paper P based on the image data DL, DC, and DR for a line after smoothing processing.

The image writing section 60 is connected to the image processing section 21 described above. The image writing section 60 comprises the laser light source 63, the optical systems 64 and 66, the light valve 65, the slit 67, the light valve driving circuit 68, the photosensitive drum 71, and the charging unit 72. The laser light source 63 is connected to the control section 15. The control section 15 carries out the light source ON/OFF control of switching ON the laser light source 63 during the period in which the data of that line is being written and switching OFF the laser light source 63 during the period between lines when no data is being written.

Further, the light valve driving circuit 68 is connected between the image processing section 21 and the light valve 65, when the image data DL, DC, and DR for a line after smoothing processing is input, it drives the light valve 65 based on ON/OFF control signal S2 from the control section and carries out the image writing processing on the photosensitive drum 71 using the laser light L. The charging unit 72 charges the photosensitive drum 71 to a specific potential before the image writing processing based on the charging control signal S3.

In the image forming section 70, the driving section 79 is connected to the control section 15 and rotates the photosensitive drum 71 on which the image has been formed by the projecting optical system 66 of the image writing section 60 based on the drive control signal S4 in a specific direction. The developing unit 73 is connected to the control section 15 and develops the electrostatic latent image formed on the photosensitive drum 71 driven by the driving section 79 based on the development control signal S5 thereby forming the toner image.

In this example, the paper feeding section 30 is connected to the control section 15 apart from the image forming section 70, and the paper P is sent out based on the paper feed control signal S6 from the control section 15, thereby feeding and transporting the paper P to the image forming section 70 via the paper feeding and transporting path not shown in the figure. The paper feeding section 30 includes the registration roller 62 which is driven by a drive source comprising solenoids, motors, etc., not shown in the figure. In this example, the paper P is transported in the paper forward movement direction (right to left) as shown in FIG. 8.

Further, in the image forming section 70, the image transferring unit 74 is connected to the control section 15 and transfers to the specific paper P the toner image developed by the developing unit 73 based on the transfer control signal S7. The writing timing in the image writing section and the paper feeding timing of the paper P fed from the paper feeding section 30 are matched by the registration roller 62. The separating unit 75 is connected to the control section 15, and separates the toner image transferred to the transfer paper by the image transferring unit 74 from the photosensitive drum 71 based on the separation control signal S8. The fixing unit 78 fixes the toner image on the transfer paper separated from the photosensitive drum 71 by separating unit 75 based on the fixing control signal S9. The paper P is discharged after fixing.

Apart from the image forming section 70, the paper feeding section 30 etc., the operation panel 48 is also connected to the control section 15. The operation panel 48 comprises the operation setting section 14 and the display section 18. A combination of a liquid crystal display and a touch panel, not shown in the figure, is used as the operation panel 48. The screen for basic settings is displayed in the display section 18, and the image forming conditions such as the number of copies, the image forming density etc., are displayed in the screen. The image forming conditions are displayed based on the display data D2. The operation setting section 14 is operated for selecting or setting the image forming conditions and for setting the automatic paper feed mode, the plate mode etc. The operation data D3 obtained due to the selection of these image forming conditions etc., is output to the control section 15.

Apart from the image memory 13, the storage section 12 is connected to the control section 15 and stores the test pattern data D4 for adjusting the image writing section 60. The test pattern data D4 has contents for setting the condition such as the degree of dispersion of the laser light L, the reflection and diffraction error of the light valve 65, the accuracy of the lens optical system, the sensitivity of the photosensitive drum 71 etc. Even the contents of adjustment settings made after the settings made by the operation setting section 14 are stored in the storage section 12.

This is because it is possible to control the image writing section 60 during the forming of one image based on the contents of adjustment settings made during the forming of the previous image. A non-volatile memory is used for the storage section 12 so that the information is no lost (erased) even when the power is switched OFF. For example, a flash ROM, EEPROM, or an SRAM with battery backup is used for the non-volatile memory.

Figure 9:
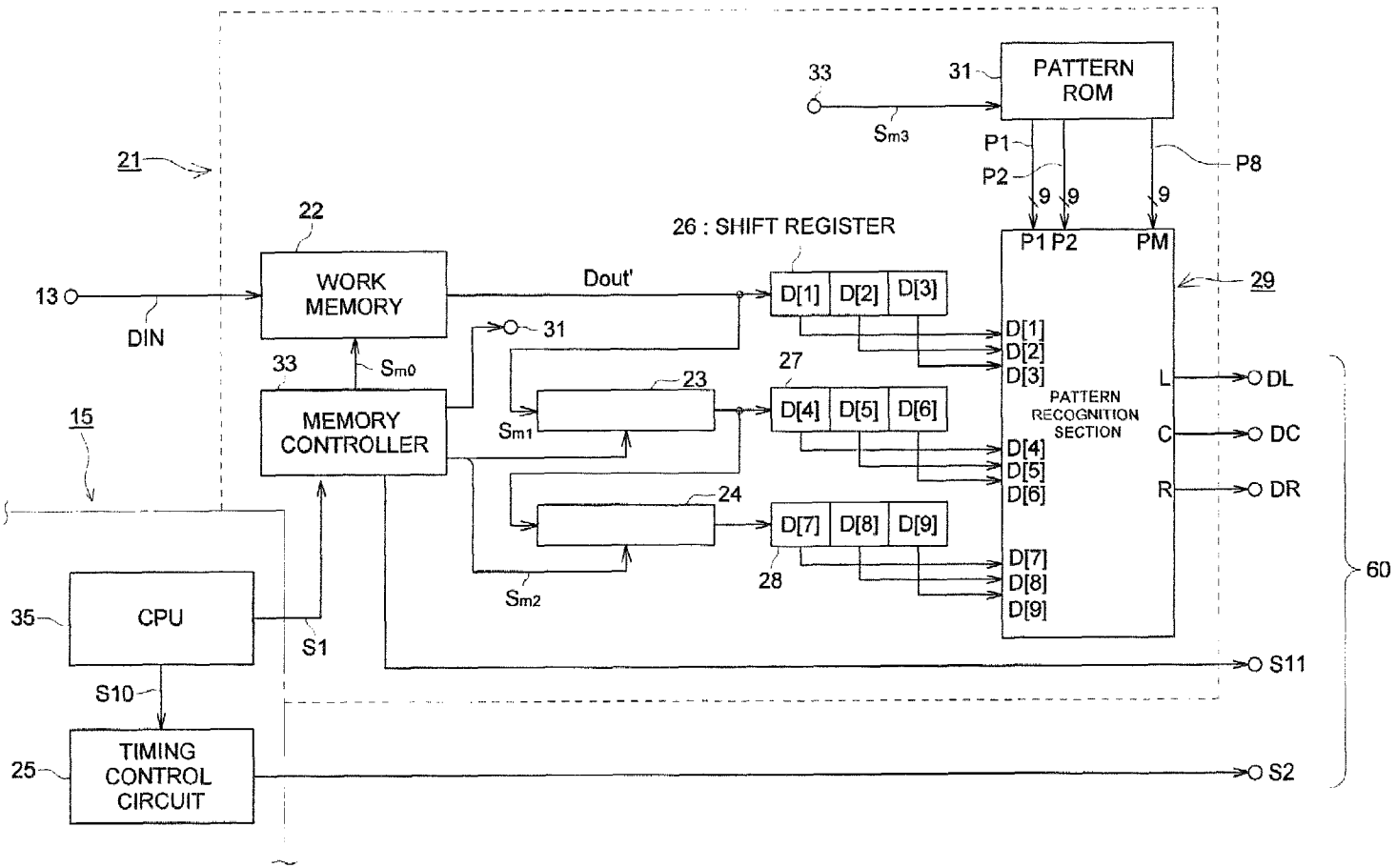
FIG. 9 is a block diagram showing an example of the configurations of the image processing section 21 and its peripheral circuits.

FIG. 9 is a block diagram showing an example of the configurations of the image processing section 21 and its peripheral circuits. Even these examples pertain to the case when each pixel is configured using three fixed ribbons 3 and three movable ribbons 4L, 4C, and 4R. The image processing section 21 shown in FIG. 9 carries out smoothing processing based on the image processing signal S1 output from the CPU 35. The image processing section 21 not only carries out pattern recognition by successively scanning the search window frames with areas corresponding to 3×3 pixels for the image based on, for example, the image data $D_{OUT}'$ of one page that has been expanded in the memory, but also outputs the image data DL or DR for the pixels that "require" smoothing processing by preparing them from the image data $D_{OUT}'$ of the current line.

The image processing section 21 is configured to comprise, for example, the working memory area 22, the line buffers 23 and 24, the three shift registers 26, 27, and 28, the pattern recognition section 29, the pattern ROM 31, and the memory control section 33. The working memory area 22 is provided in the image processing section 21 which stores, for example, the image data $D_{IN}$ in units of one page received from the image memory 13 based on the memory control signal Sm0. The line buffers 23 and 24 and the shift register 26 are connected to the working memory area 22. The image data D [1] of the pixel diagonally above to the left as seen from the target pixel of the image data $D_{OUT}'$ of the concerned line, the image data D [2] of the pixel immediately above the target pixel, and the image data D [3] of the pixel diagonally above to the right as seen from the target pixel are latched in the shift register 26.

In the line buffer 23 is stored, for example, the image data $D_{OUT}'$ delayed by one line from the concerned line and read out from the working memory area 22 based on the memory control signal Sm1. The line buffer 23 is connected to the shift register 27 which latches the image data D [4] of the pixel to the left as seen from the target pixel of the image data $D_{OUT}'$ of the concerned line, and similarly the image data D [6] of the pixel to the right as seen from the target pixel. Of course, the image data D [5] of the target pixel itself is also latched in this shift register.

In the line buffer 24 is stored, for example, the image data $D_{OUT}'$ delayed by two lines from the concerned line and read out from the working memory area 22 based on the memory control signal Sm2. The line buffer 23 is connected to the shift register 28 which latches the image data D [7] of the pixel diagonally below to the left as seen from the target pixel of the image data $D_{OUT}'$ of the concerned line, the image data D [8] of the pixel immediately below the target pixel, and similarly the image data D [9] of the pixel diagonally below to the right as seen from the target pixel.

The pattern recognition section 29 is connected to the shift registers 26 to 28 described above. The image data D [1], D [2], and D [3] corresponding to three pixels are output from the shift register 26 to the pattern recognition section 29. In a similar manner, the image data D [4], D [5], and D [6] corresponding to three pixels are output from the shift register 28 to the pattern recognition section 29. The image data D [7], D [8], and D [9] corresponding to three pixels are output from the shift register 28 to the pattern recognition section 29. Because of this, successive scanning is made of the search window frames with areas corresponding to 3×3 pixels for the image that has been expanded in the memory.

The memory control section 33 is connected to the line buffers 23 and 24 and to the pattern recognition section 29 described above and generates the memory control signals Sm1 to Sm3 based on the image processing signal S1. The memory control signal Sm1 is output from the memory control section 33 to the line buffer 23, and the memory control signal Sm2 is output to the line buffer 24. Although not shown in the figure, control signals such as the set and reset signals are output from the memory control section 33 to the shift registers 26 to 28.

Further, the pattern ROM 31 is connected to the pattern recognition section 29. In the pattern ROM 31 are stored the pattern data Pi [j] (i=1~M, j=1~9) related to the smoothing pattern (the reference pattern for comparison) of M types necessary for carrying out the smoothing processing. This example corresponds to the case M=8, for which the smoothing patterns P1 to P8 have been prepared for 3×3 pixels. The pattern data Pi [j] corresponding to the smoothing patters P1 to P8 are read out by the pattern recognition section 29 based on the memory control signal Sm3. In this example, the pattern data Pi [j] are transferred from the pattern ROM 31 to the pattern recognition section 29 in parallel so that all the smoothing patterns can be recognized simultaneously.

The timing generation circuit 25 is connected to the CPU 35 described above and generates the ON/OFF control signal S2 based on the timing control signal S10. This signal S2 is output to the light valve driving circuit 68. Furthermore, the memory control section 33 described above generates also the offset control signal S11 in addition to generating the memory control signals Sm1 to Sm3, and this signal 511 is output to the light valve control circuit 68. Further, the timing generation circuit 25 may also be provided within the control section 15.

Figure 10:
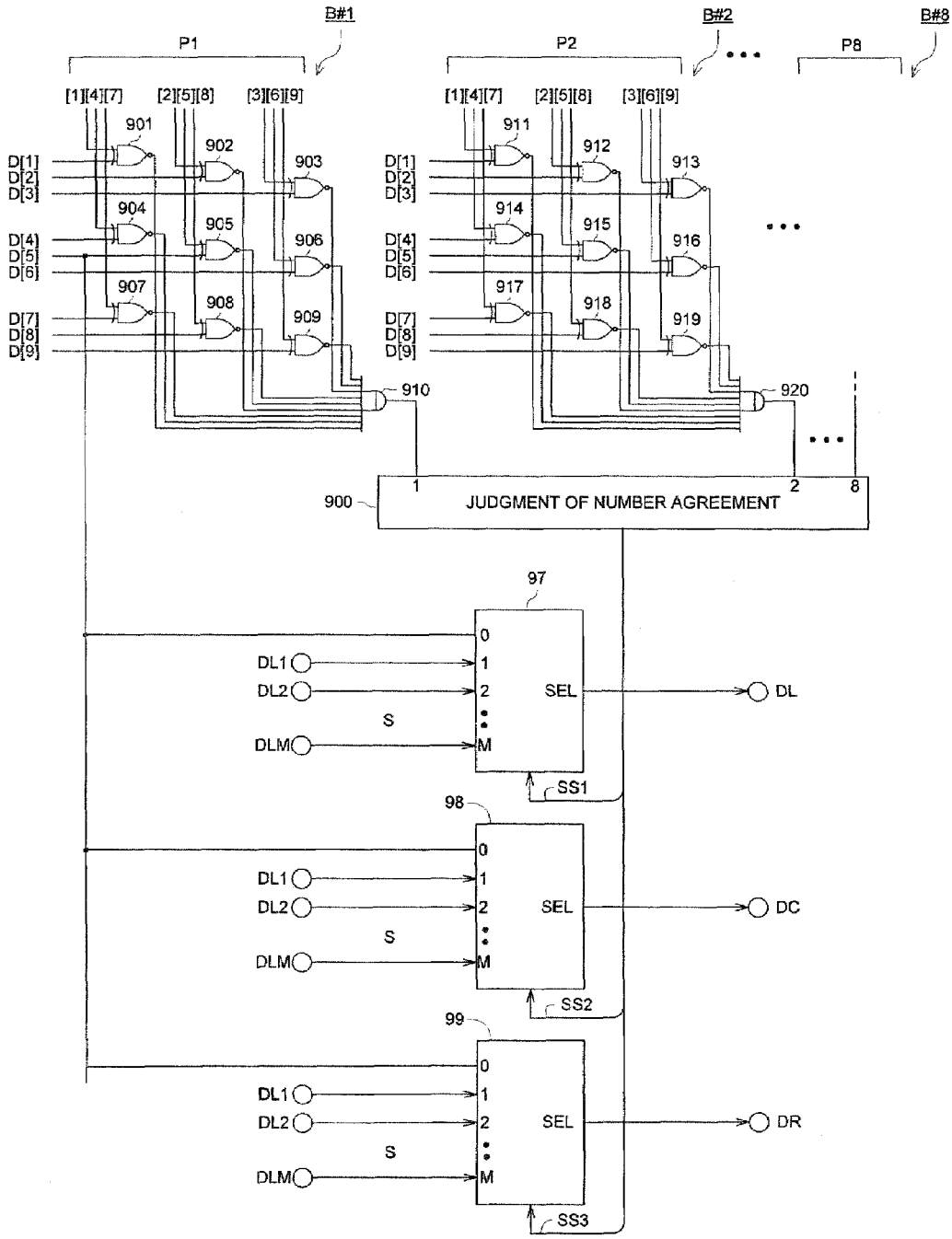
FIG. 10 is a circuit diagram showing an example of the configuration of the pattern recognition section 29.

FIG. 10 is a circuit diagram showing an example of the configuration of the pattern recognition section 29. The pattern recognition section 29 shown in FIG. 10 receives inputs of the image data $D_{OUT}'$ and the pattern data Pi [j] for each image corresponding to a window frame equivalent to 3×3 pixels and computes their exclusive OR sum.

The pattern recognition section 29 comprises the first to eighth processing blocks B#1 to B#8 that execute the comparison processing related to the smoothing patterns P1 to PM, the judgment of number agreement section 900, the selector 97 for the left ribbon, the selector 98 for the central ribbon, and the selector 99 for the right ribbon.

The first processing block B#1 has the nine 2-input Exclusive NOR circuits 901 to 909 and one 9-input logical product circuit 910. The 2-input Exclusive NOR circuit 901 takes as input the image data D [1] and the pattern data P1 [1] and computes their logical Exclusive OR sum and outputs the negation of that result to the 9-input logical product circuit 910.

The 2-input Exclusive NOR circuit 902 takes as input the image data D [2] and the pattern data P1 [2], computes their logical Exclusive OR sum and outputs the negation of that result to the 9-input logical product circuit 910. The 2-input Exclusive NOR circuit 903 takes as input the image data D [3] and the pattern data P1 [3], computes their logical Exclusive OR sum and outputs the negation of that result to the 9-input logical product circuit 910. The 2-input Exclusive NOR circuit 904 takes as input the image data D [4] and the pattern data P1 [4], computes their logical Exclusive OR sum and outputs the negation of that result to the 9-input logical product circuit 910.

The 2-input Exclusive NOR circuit 905 takes as input the image data D [5] and the pattern data P1 [5], computes their logical Exclusive OR sum and outputs the negation of that result to the 9-input logical product circuit 910. The 2-input Exclusive NOR circuit 906 takes as input the image data D [6] and the pattern data P1 [6], computes their logical Exclusive OR sum and outputs the negation of that result to the 9-input logical product circuit 910. The 2-input Exclusive NOR circuit 907 takes as input the image data D [7] and the pattern data P1 [7], computes their logical Exclusive OR sum and outputs the negation of that result to the 9-input logical product circuit 910. The 2-input Exclusive NOR circuit 908 takes as input the image data D [8] and the pattern data P1 [8], computes their logical Exclusive OR sum and outputs the negation of that result to the 9-input logical product circuit 910.

The 2-input Exclusive NOR circuit 909 takes as input the image data D [9] and the pattern data P1 [9], computes their logical Exclusive OR sum and outputs the negation of that result to the 9-input logical product circuit 910. All the negated signals output from the 2-input Exclusive NOR circuits 901 to 909 are input to the 9-input logical product circuit 910 thereby computing their logical product, and the output signal of this computation is output to the judgment of number agreement section 900. When the image data D [1] to D [9] match with the pattern data Pi [j] for all the pixels, the logical product for that smoothing pattern becomes "1".

Further, even the second processing block B#2 carrying out the comparison processing related the smoothing pattern P2 has the nine 2-input Exclusive NOR circuits 911 to 919 and one 9-input logical product circuit 920. The 2-input Exclusive NOR circuit 911 takes as input the image data D [1] and the pattern data P2 [1] and computes their logical Exclusive OR sum and outputs the negation of that result to the 9-input logical product circuit 920.

The 2-input Exclusive NOR circuit 912 takes as input the image data D [2] and the pattern data P2 [2], computes their logical Exclusive OR sum and outputs the negation of that result to the 9-input logical product circuit 920. The 2-input Exclusive NOR circuit 913 takes as input the image data D [3] and the pattern data P2 [3], computes their logical Exclusive OR sum and outputs the negation of that result to the 9-input logical product circuit 920. The 2-input Exclusive NOR circuit 914 takes as input the image data D [4] and the pattern data P2 [4], computes their logical Exclusive OR sum and outputs the negation of that result to the 9-input logical product circuit 920.

The 2-input Exclusive NOR circuit 915 takes as input the image data D [5] and the pattern data P2 [5], computes their logical Exclusive OR sum and outputs the negation of that result to the 9-input logical product circuit 920. The 2-input Exclusive NOR circuit 916 takes as input the image data D [6] and the pattern data P2 [6], computes their logical Exclusive OR sum and outputs the negation of that result to the 9-input logical product circuit 920. The 2-input Exclusive NOR circuit 917 takes as input the image data D [7] and the pattern data P2 [7], computes their logical Exclusive OR sum and outputs the negation of that result to the 9-input logical product circuit 920. The 2-input Exclusive NOR circuit 918 takes as input the image data D [8] and the pattern data P2 [8], computes their logical Exclusive OR sum and outputs the negation of that result to the 9-input logical product circuit 920.

The 2-input Exclusive NOR circuit 919 takes as input the image data D [9] and the pattern data P2 [9], computes their logical Exclusive OR sum and outputs the negation of that result to the 9-input logical product circuit 920. All the negated signals output from the 2-input Exclusive NOR circuits 911 to 919 are input to the 9-input logical product circuit 920 thereby computing their logical product, and the output signal of this computation is output to the judgment of number agreement section 900. When the image data D [1] to D [9] match with the pattern data Pi [j] for all the pixels, the logical product for that smoothing pattern becomes "1".

Thereafter, in a similar manner, even the third to eighth processing blocks B#3 to B#8 carrying out the comparison processing related the smoothing patterns P3 to P8 have nine 2-input Exclusive NOR circuits and one 9-input logical product circuit, the operations and functions of which are similar to those described above. For example, the logical products described above are obtained in parallel for the image data D [1] to D [9] for all the pattern data Pi [j]

In the judgment of number agreement section 900, the logical product results of the eight 9-input logical product circuits 910, 920, . . . are collected together, and the matching number is output to the selectors 97 to 99 as the judgment result number. The selector selection signal SS1 is input to the selector 97, SS2 is input to the selector 98, and SS3 is input to the selector 99.

The three selectors 97 to 99 described above are connected to the judgment of number agreement section 900. The image data D [5] of the target pixel and the image data DL1 to DL8 for the left ribbon corresponding to the 8 types of smoothing patterns P1 to P8 are input to selector 97, and one image data DL is selected from among the 9 image data D [5] and DL1 to DL8 for the left ribbon based on the selector selection signals SS1. When, for example, the selector selection signal SS1 corresponding to "1" is input to the selector 97 as the judgment result number, the image data DL1 for the left ribbon corresponding to the smoothing pattern P1 will be selected and output by this selector 97.

Further, when the selector selection signals SS1 corresponding to "2" is input to the selector 97, the image data DL2 for the left ribbon corresponding to the smoothing pattern P2 will be selected and output by this selector 97, and, when the selector selection signals SS1 corresponding to "3" is input to the selector 97, the image data DL3 for the left ribbon corresponding to the smoothing pattern P3 will be selected and output by this selector 97. Similarly, when the selector selection signals SS1 corresponding to "8" is input to the selector 97, the image data DL8 for the left ribbon corresponding to the smoothing pattern P8 will be selected, and this selected signal is input to the image writing section 60 as the image data DL for the left ribbon.

The image data D [5] of the target pixel and the image data DC1 to DC8 for the central ribbon corresponding to the 8 types of smoothing patterns P1 to P8 are input to selector 98, and one image data DC is selected from among the 9 image data D [5] and DC1 to DC8 for the central ribbon based on the selector selection signal SS2. When, for example, the selector selection signals SS2 corresponding to "1" is input to the selector 98 as the judgment result number, the image data DC1 for the central ribbon corresponding to the smoothing pattern P1 will be selected and output by this selector 98.

Further, when the selector selection signal SS2 corresponding to "2" is input to the selector 98, the image data DC2 for the central ribbon corresponding to the smoothing pattern P2 will be selected and output by this selector 98, and, when the selector selection signal SS2 corresponding to "3" is input to the selector 98, the image data DC3 for the central ribbon corresponding to the smoothing pattern P3 will be selected and output by this selector 98. Similarly, when the selector selection signal SS2 corresponding to "8" is input to the selector 98, the image data DC8 for the central ribbon corresponding to the smoothing pattern P8 will be selected, and this selected signal is input to the image writing section 60 as the image data DC for the central ribbon.

The image data D [5] of the target pixel and the image data DR1 to DR8 for the right ribbon corresponding to the 8 types of smoothing patterns P1 to P8 are input to selector 99, and one image data DR is selected from among the 9 image data D [5] and DR1 to DR8 for the right ribbon based on the selector selection signal SS3. When, for example, the selector selection signal SS3 corresponding to "1" is input to the selector 99 as the judgment result number, the image data DR1 for the right ribbon corresponding to the smoothing pattern P1 will be selected and output by this selector 99.

Further, when the selector selection signal SS3 corresponding to "2" is input to the selector 99, the image data DR2 for the right ribbon corresponding to the smoothing pattern P2 will be selected and output by this selector 99, and, when the selector selection signal SS3 corresponding to "3" is input to the selector 99, the image data DR3 for the right ribbon corresponding to the smoothing pattern P3 will be selected and output by this selector 99. Similarly, when the selector selection signal SS3 corresponding to "8" is input to the selector 99, the image data DR8 for the right ribbon corresponding to the smoothing pattern P8 will be selected, and this selected signal is input to the image writing section 60 as the image data DR for the right ribbon.

Further, when the judgment result number is "0", the original image data $D_{OUT}'$ will not be changed but will be output as it is to the image writing section 60. For example, when not even one judgment result is present for which the logical product is equal to "1", the selector selection signal SS1 corresponding to "0" is input to the selector 97 for the left ribbon, the selector selection signal SS2 corresponding to "0" is input to the selector 98 for the central ribbon, and the selector selection signal SS3 corresponding to "0" is input to the selector 99 for the right ribbon. Because of this, it is possible to generate the image data DL, DC, and DR for the left, central, and the right ribbons corresponding to the judgment result number, and these image data DL, DC, and DR can be output to the image writing section 60.

Figure 11:
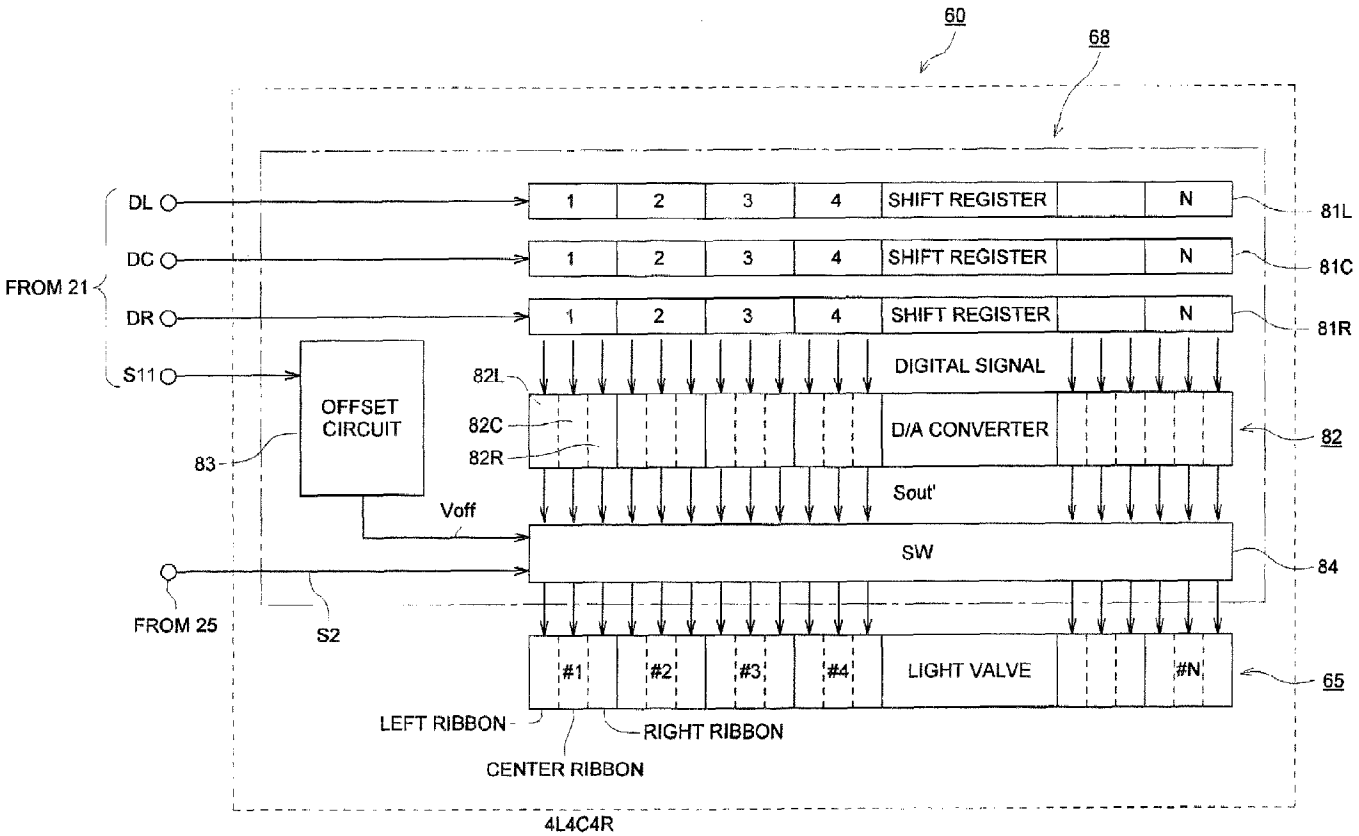
FIG. 11 is a block diagram showing an example of the configuration of the image writing section 60.

FIG. 11 is a block diagram showing an example of the configuration of the image writing section 60. The image writing section 60 shown in FIG. 11 comprises the light valve 65 and the light valve driving circuit 68.

The light valve driving circuit 68 is connected to the pattern recognition section 29 shown in FIG. 9, the image data DL, DC, and DR for the left, central, and right ribbons are input from the selectors 97 to 98 and the left, central, and the right ribbons 4L, 4C, and 4R are driven independently. The light valve driving circuit 68 comprises the shift registers 81L, 81C, and 81R, the D/A converter 82, the offset circuit 83, and the switching circuit (SW) 84.

The shift register 81L is connected to the selector 97 shown in FIG. 10. The shift register 81L holds (latches) the serial image data DL for N pixels after smoothing processing and output from the pattern recognition section 29. The shift register 81C is connected to the selector 98 shown in FIG. 10. The shift register 81C holds (latches) the serial image data DC for N pixels after smoothing processing and output from the pattern recognition section 29. The shift register 81R is connected to the selector 99 shown in FIG. 10. The shift register 81R holds (latches) the serial image data DR for N pixels after smoothing processing and output from the pattern recognition section 29.

The shift registers 81L, 81C, and 81R are connected to the D/A converter 82. The D/A converter 82 is provided in the form of N sets of three D/A converters each for the central movable ribbon, the left movable ribbon, and the right movable ribbon of each pixel in the light valve 65.

The D/A converter 82C is connected to the shift register 81C, reads out the parallel digital image data DC for N pixels, and converts it into an analog image signal Sout' for the movable ribbon at the center of one pixel of the light valve 65 (the central movable ribbon 4C). The D/A converter 82L is connected to the shift register 81L, reads out the parallel digital image data DL for N pixels, and in a similar manner to the above, converts it into an analog image signal Sout' for the movable ribbon at the left of one pixel of the light valve 65 (the left movable ribbon 4L) The D/A converter 82R is connected to the shift register 81R, reads out the parallel digital image data DR for N pixels, and in a similar manner to the above, converts it into an analog image signal Sout' for the movable ribbon at the right of one pixel of the light valve 65 (the right movable ribbon 4R).

Each of the D/A converters 82L, 82C, and 82R are connected to the switching circuit 84. The offset circuit 83 and the timing generator circuit 25 are connected to the switching circuit 84. The offset circuit 83 outputs the offset voltage Voff to the switching circuit 84 based on the offset control signal S11.

In the switching circuit 84, during the image writing period based on the ON/OFF control signal S2, the offset voltage Voff based on the analog image signal Sout' for the left movable ribbon 4L, the central movable ribbon 4C, and the right movable ribbon 4R is output as the writing voltage Vw to the pixels #1 to #N of the light valve 65. In the light valve 65, ON/OFF operation is made based on the writing voltage Vw after smoothing processing. Because of the ON/OFF operation of the light valve 65 it is possible to carry out modulation of the laser light L along with smoothing processing. The zero order diffracted light L0 after this modulation is passed through the slit 67 shown in FIG. 7 and FIG. 8 and is projected on to the photosensitive drum 71.

Figure 12:
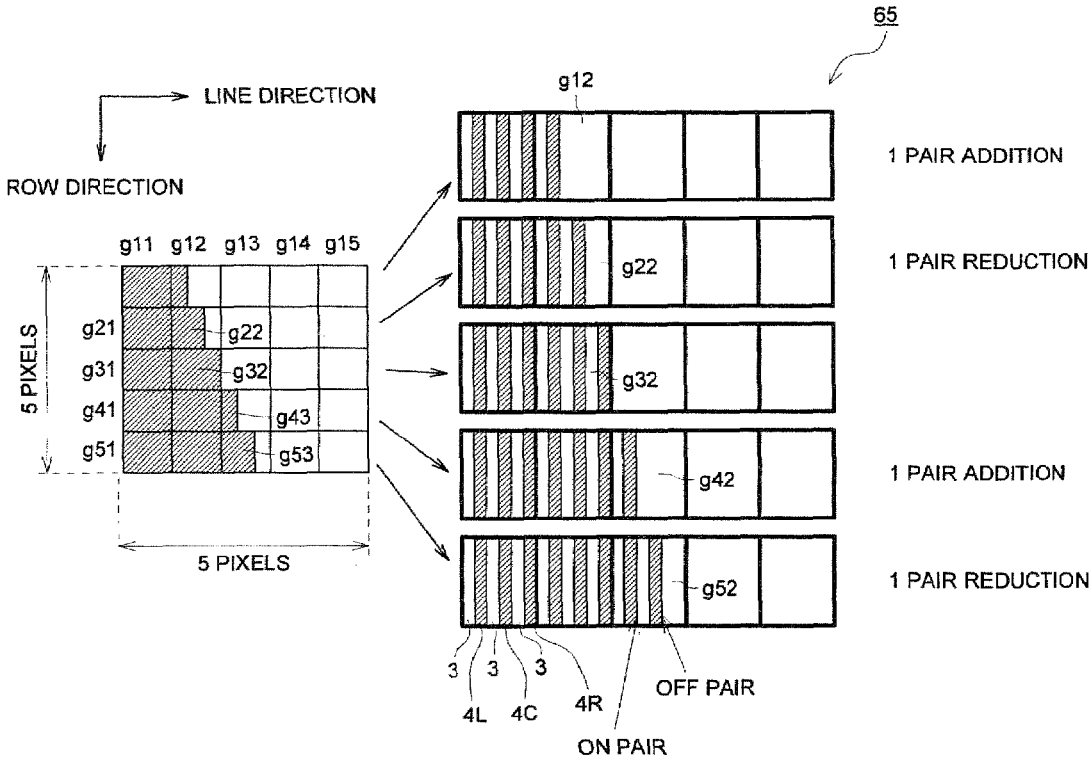
FIGS. 12(A) and 12(B) are diagrams showing an example of image formation related to smoothing processing and an example of driving the light valve.

FIGS. 12 (A) and (B) are diagrams showing an example of image formation related to smoothing processing and an example of driving the light valve.

FIG. 12 (A) is an example of the image of an inclined line formed based on the image data $D_{OUT}'$ from which is extracted a matrix-shaped part of five pixels in the row direction and five pixels in the column direction. The inclined line part is the black part in which the image data "1" is written. The white-on-black background part is the white part in which the image data "0" is written.

In this example, the pixel numbers g11, g21, g31, g32, g41, g42, g51, and g52 are the black part in which the image data "1" is written. The pixel numbers g13 to g15, g23 to g25, g33 to g35, g44, g45, g54, and g55 are the white part in which the image data "0" is written.

The border between these white parts and black parts is only the pixel number g12 which is the black part having the image data "1" written in only ⅓ pixel. The pixel number g22 which is the white part having the image data "0" written in only ⅓ pixel. The pixel number g43 which is the black part having the image data "1" written in only ⅓ pixel. The pixel number g53 which is the white part having the image data "0" written in only ⅓ pixel. In this manner, by carrying out smoothing processing of an inclined line image it is possible to reduce the jagged part 8 that appears in a conventional method.

In order to make ⅓ pixel black in the pixel number g12 as shown in FIG. 12 (A), it is sufficient to drive one additional pair of ribbons in the light valve 65 corresponding to the pixel number g12 neighboring the pixel number g11 as shown in FIG. 12 (B). In this example, the pair of the fixed ribbon 3 and the left movable ribbon 4L nearest to the border between the pixel number g11 and the pixel number g12 is added to the target of driving (made an ON pair). The writing voltage Vw based on the image data DL="1" for the left movable ribbon 4L, the image data DC="0" for the central movable ribbon 4C, the image data DR="0" for the right movable ribbon 4R obtained from the pattern recognition section 29 shown in FIG. 10 is applied to the left movable ribbon 4L. This is expressed as the image data (DL, DC, DR)=(1, 0, 0).

Further, in order to make ⅓ pixel white in the pixel number g22, it is sufficient to remove one pair of ribbons in the light valve 65 corresponding to the pixel number g22 from the target of driving. In this example, the pair of the fixed ribbon 3 and the right movable ribbon 4R nearest to the border of the pixel number g22 is removed from the target of driving (made an OFF pair). In this case, the writing voltage Vw is applied only to the left movable ribbon 4L and to the central movable ribbon 4C of the light valve 65 forming the pixel number g22. This is expressed as the image data (DL, DC, DR)=(1, 1, 0).

In a similar manner, in order to make ⅓ pixel black in the pixel number g43, it is sufficient to drive one additional pair of ribbons in the light valve 65 corresponding to the pixel number g43 neighboring the pixel number g42. In this example, the pair of the fixed ribbon 3 and the left movable ribbon 4L nearest to the border between the pixel number g42 and the pixel number g43 is added to the target of driving (made an ON pair). The writing voltage Vw based on the image data DL="1" for the left movable ribbon 4L is applied to the left movable ribbon 4L. This is expressed as the image data (DL, DC, DR)=(1, 0, 0).

Further, in order to make ⅓ pixel white in the pixel number g53, it is sufficient to remove one pair of ribbons in the light valve 65 corresponding to the pixel number g53 from the target of driving. In this example, the pair of the fixed ribbon 3 and the right movable ribbon 4R nearest to the border of the pixel number g53 is removed from the target of driving (made an OFF pair). In this case, the writing voltage Vw is applied only to the left movable ribbon 4L and to the central movable ribbon 4C of the light valve 65 forming the pixel number g53. This is expressed as the image data (DL, DC, DR)=(1, 1, 0). In this manner, by driving the light valve 65 it is possible to form the image of an inclined line smooth as is shown in FIG. 12 (A).

FIGS. 13 (A) to (H) are diagrams showing examples of the relationships between the pattern data Pi [j] and the image data for each of the ribbons (DL, DC, DR).

In this example, the pattern data Pi [j] (i=1~M, j=1~9) for the M=8 types of smoothing patterns P1 to P8 necessary for the smoothing processing is stored in the pattern ROM 31 shown in FIG. 9. The pattern data Pi [j] is used for setting a window frame of 3×3 pixels and comparing the central pixel (referred to hereinafter as the target pixel) with the surrounding pixels in the neighborhood.

The pattern data related to the first smoothing pattern P1 shown in FIG. 13 (A) is denoted by 9 values of P1 [j] (j=1~9). In this example, the pattern data P1 [1], P1 [4], P1 [7], and P1 [8] are all equal to the image data "1". The pattern data P1 [2], P1 [3], P1 [5], P1 [6], and P1 [9] are all equal to the image data "0". The image data (DL, DC, DR) for the different ribbons related to the smoothing pattern P1 is (1, 0, 0). This means DL=1, DC=0, and DR=0, which notation is the same in the following.

Even the pattern data related to the second smoothing pattern P2 shown in FIG. 13 (B) is denoted by 9 values of P2 [j] (j=1~9). In this example, the pattern data P2 [1], P2 [2], P2 [4], and P2 [7] are all equal to the image data "1". The pattern data P2 [3], P2 [5], P2 [6], P2 [8], and P2 [9] are all equal to the image data "0". The image data (DL, DC, DR) for the different ribbons related to the smoothing pattern P2 is (1, 0, 0).

Even the pattern data related to the third smoothing pattern P3 shown in FIG. 13 (C) is denoted by 9 values of P3 [j] (j=1~9). In this example, the pattern data P3 [1], P3 [4], P3 [5], P3 [7], and P3 [8] are all equal to the image data "1". The pattern data P3 [2], P3 [3], P3 [6], and P3 [9] are all equal to the image data "0". The image data (DL, DC, DR) for the different ribbons related to the smoothing pattern P3 is (1, 1, 0).

Even the pattern data related to the fourth smoothing pattern P4 shown in FIG. 13 (D) is denoted by 9 values of P4 [j] (j=1~9). In this example, the pattern data P4 [1], P4 [2], P4 [4], P4 [5], and P4 [7] are all equal to the image data "1". The pattern data P4 [3], P4 [6], P4 [8], and P4 [9] are all equal to the image data "0". The image data (DL, DC, DR) for the different ribbons related to the smoothing pattern P4 is (1, 1, 0).

The pattern data related to the fifth smoothing pattern P5 shown in FIG. 13 (E) is denoted by 9 values of P5 [j] (j=1~9). In this example, the pattern data P5 [3], P5 [6], P5 [8], and P5 [9] are all equal to the image data "1". The pattern data P5 [1], P5 [2], P5 [4], P5 [5], and P5 [7] are all equal to the image data "0". The image data (DL, DC, DR) for the different ribbons related to the smoothing pattern P5 is (0, 0, 1).

Even the pattern data related to the sixth smoothing pattern P6 shown in FIG. 13 (F) is denoted by 9 values of P6 [i] (j=1~9). In this example, the pattern data P6 [2], P6 [3], P6 [6], and P6 [9] are all equal to the image data "1". The pattern data P6 [1], P6 [4], P6 [5], P6 [7], and P6 [8] are all equal to the image data "0". The image data (DL, DC, DR) for the different ribbons related to the smoothing pattern P6 is (0, 0, 1).

Even the pattern data related to the seventh smoothing pattern P7 shown in FIG. 13 (G) is denoted by 9 values of P7 [j] (j=1~9). In this example, the pattern data P7 [3], P7 [5], P7 [6], P7 [8], and P7 [9] are all equal to the image data "1". The pattern data P7 [1], P7 [2], P7 [4], and P7 [7] are all equal to the image data "0". The image data (DL, DC, DR) for the different ribbons related to the smoothing pattern P7 is (0, 1, 1).

Even the pattern data related to the eighth smoothing pattern P8 shown in FIG. 13 (H) is denoted by 9 values of P8 [j] (j=1~9). In this example, the pattern data P8 [2], P8 [3], P8 [5], P8 [6], and P8 [9] are all equal to the image data "1". The pattern data P8 [1], P8 [4], P8 [7], and P8 [8] are all equal to the image data "0". The image data (DL, DC, DR) for the different ribbons related to the smoothing pattern P8 is (0, 1, 1). The pattern data Pi [j] related to these eight types of smoothing patterns P1 to P8 are stored in the pattern ROM 31, and are read out by the pattern recognition section 29 based on the memory control signal Sm3 for carrying out smoothing processing.

FIGS. 14 (A) to (C) and FIGS. 15 (A) to (C) are diagrams showing examples of smoothing processing in the image processing section 21. In FIGS. 14 (A) and (C), the inclined line section in both cases is the black part in which the image data "1". The white-on-black background part is the white part in which the image data "0" is written.

In this example, during pattern recognition processing, the pixels of the input image data D [1] ~D [9] within a window frame of 3×3 pixels before correction are compared with the pixels of the pattern data P1 [j] of the smoothing pattern P1 by the 2-input Exclusive OR circuits 901~909 of the first processing block B#1~B#8 shown in FIG. 10 (B).

In the example shown in FIG. 14 (A), the input image data D [1]="1" of the 3 pixel×3 pixel frame before correction matches with the pattern data P1 [1]="1", and also D [4]="1" and P1 [4]="1" match, D [7]="1" and P1 [7]="1" match, D [8]="1" and P1 [8]="1" match.

Further, this is the case when the input image data D [2]="0" matches with the pattern data P1 [2]="0", D [3]="0" matches with P1 [3]="0", D [5]="0" matches with P1 [5]="0", D [6]="0" matches with P1 [6]="0", D [9]="0" matches with P1 [9]="0".

In this case, since it is recognized that the input image data D [1]~D [9] of 3×3 pixels matches with the pattern data P1 [j] of the smoothing pattern P1 in all pixels, in order to make ⅓ pixel of the target pixel g22 after correction shown in FIG. 14 (A) a black part, only one pair of the ribbons of the light valve forming that target pixel g22 is driven additionally. The pair of the fixed ribbon 3 and the left movable ribbon 4L forming that target pixel g22 is added to the target of driving (made an ON pair). The image data is (DL, DC, DR)=(1, 0, 0). The writing voltage Vw based on the image data DL for the left movable ribbon 4L and obtained from the pattern recognition section 29 shown in FIG. 10 is applied to the left movable ribbon 4L of the target pixel g22.

In the example shown in FIG. 14 (B), the input image data D [1]="1" of the 3 pixel×3 pixel frame before correction matches with the pattern data P3 [1]="1", and also D [4]="1" and P3 [4]="1" match, D [5]="1" and P3 [5]="1" match, D [7]="1" and P3 [7]="1" match, and D [8]="1" and P3 [8]="1" match.

Further, this is the case when the input image data D [2]="0" matches with the pattern data P3 [2]="0", D [3]="0" matches with P3 [3]="0", D [6]="0" matches with P3 [6]="0", and D [9]="0" matches with P3 [9]="0".

In this case, since it is recognized that the input image data D [1]~D [9] of 3×3 pixels matches with the pattern data P3 [j] of the smoothing pattern P3 in all pixels, in order to make ⅓ pixel of the target pixel g22 after correction shown in FIG. 14 (B) a white part, only one pair of the ribbons of the light valve forming that target pixel g22 is removed from the target of driving. The pair of the fixed ribbon 3 and the right movable ribbon 4R forming that target pixel g22 is removed from the target of driving (made an OFF pair). The image data is (DL, DC, DR)=(1, 1, 0). The writing voltages Vw based on the image data DL for the left movable ribbon 4L and based on the image data DC for the central movable ribbon 4C and obtained from the pattern recognition section 29 shown in FIG. 10 are applied to the remaining left movable ribbon 4L and the central movable ribbon 4C of the target pixel g22.

In the example shown in FIG. 14 (C), the input image data D [3]="1" of the 3 pixel×3 pixel frame before correction matches with the pattern data P5 [3]="1", and D [6]="1" and P5 [6]="1" match, D [8]="1" and P5 [8]="1" match, and D [9]="1" and P5 [9]="1" match.

Further, this is the case when the input image data D [1]="0" matches with the pattern data P5 [1]="0", D [2]="0" matches with P5 [2]="0", D [4]="0" matches with P5 [4]="0", D [5]="0" matches with P5 [5]="0", and D [7]="0" matches with P5 [7]="0".

In this case, since it is recognized that the input image data D [1]~D [9] of 3×3 pixels matches with the pattern data P5 [j] of the smoothing pattern P5 in all pixels, in order to make ⅓ pixel of the target pixel g22 after correction shown in FIG. 14 (C) a black part, only one pair of the ribbons of the light valve forming that target pixel g22 is added to the target of driving. The pair of the fixed ribbon 3 and the right movable ribbon 4R forming that target pixel g22 is added to the target of driving (made an ON pair). The image data is (DL, DC, DR)=(0, 0, 1). The writing voltage Vw based on the image data DR for the right movable ribbon 4R and is obtained from the pattern recognition section 29 shown in FIG. 10 is applied to the right movable ribbon 4R of the target pixel g22.

In the example shown in FIG. 15 (A), the input image data D [3]="1" of the 3 pixel×3 pixel frame before correction matches with the pattern data P7 [3]="1", and also D [5]="1" and P7 [5]="1" match, D [6]="1" and P7 [6]="1" match, D [8]="1" and P7 [8]="1" match, and D [9]="1" and P7 [9]="1" match.

Further, this is the case when the input image data D [1]="0" matches with the pattern data P7 [1]="0", D [2]="0" matches with P7 [2]="0", D [4]="0" matches with P7 [4]="0", and D [7]="0" matches with P7 [7]="0".

In this case, since it is recognized that the input image data D [1]~D [9] of 3×3 pixels matches with the pattern data P7 [j] of the smoothing pattern P7 in all pixels, in order to make ⅓ pixel of the target pixel g22 after correction shown in FIG. 15 (A) a white part, only one pair of the ribbons of the light valve forming that target pixel g22 is removed from the target of driving.

The pair of the fixed ribbon 3 and the left movable ribbon 4L forming that target pixel g22 is removed from the target of driving (made an OFF pair). The image data is (DL, DC, DR)=(0, 1, 1). The writing voltages Vw based on the image data DC for the central movable ribbon 4C and based on the image data DR for the right movable ribbon 4R and obtained from the pattern recognition section 29 shown in FIG. 10 are applied to the remaining central movable ribbon 4C and the right movable ribbon 4R of the target pixel g22.

The example shown in FIG. 15 (B) is the case when "1" has been written in each of the pixels D [1], D [7], and D [8] in the input image data D [1]~D [9] and "0" has been written in each of the pixels D [2] ~D [6], and D [9]. In this case, since it is recognized that there is not even a single matching between the input image data D [1]~D [9] of 3×3 pixels and the eight types of the smoothing patterns P1~P8 when all the patterns have been compared, the target pixel g22 after correction shown in FIG. 15 (B) is not modified but remains as it is as the image data D [5]="0". In this example, the writing voltage Vw=0 is applied based on the image data (DL, DC, DR)=(0, 0, 0).

Further, the example shown in FIG. 15 (C) is the case when "1" has been written in each of the pixels D [1], D [4]~D [8] in the input image data before correction D [1] D [9] of 3×3 pixels and "0" has been written in each of the pixels D [2], D [3], and D [9]. Even in this case, since it is recognized that there is not even a single matching between the input image data D [1]~D [9] of 3×3 pixels and the eight types of the smoothing patterns P1~P8 when all the patterns have been compared, the target pixel g22 after correction shown in FIG. 15 (C) is not modified but remains as it is as the image data D [5]="1". In this example, the writing voltage Vw=1 is applied based on the image data (DL, DC, DR)=(1, 1, 1).

Figure 16:
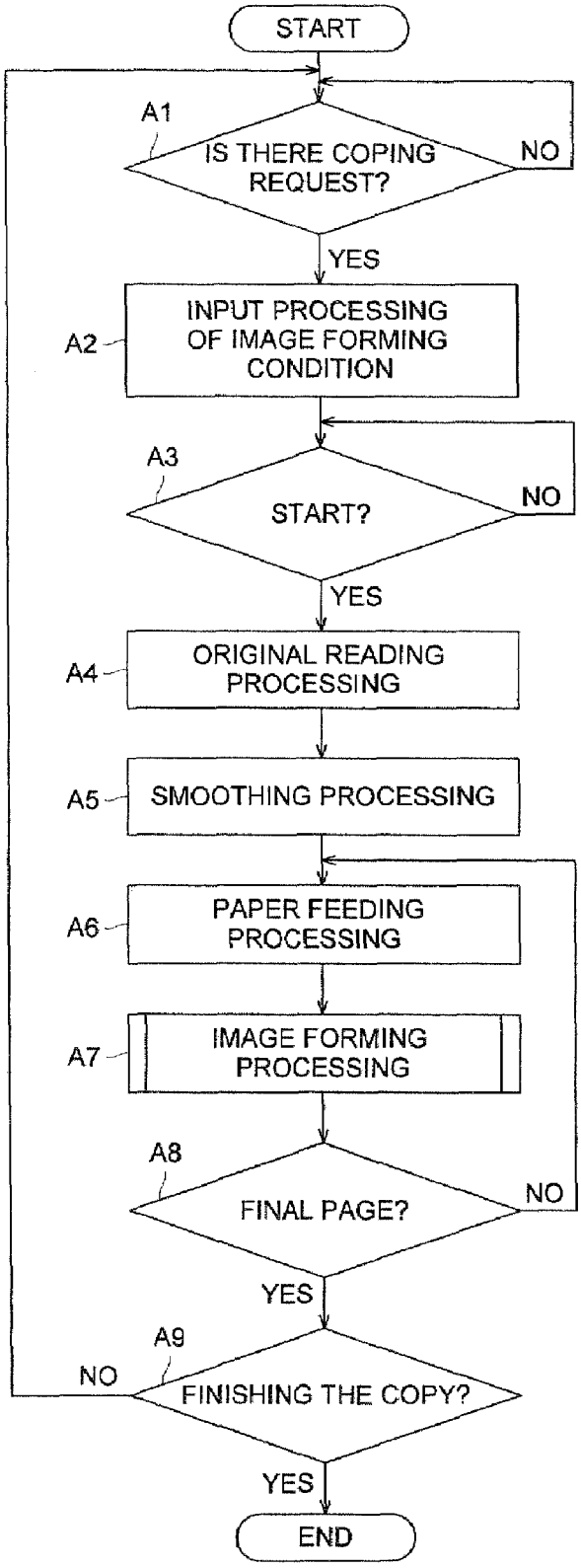
FIG. 16 is a flow chart showing an example of the operations during copying in the copying machine 100.
Figure 17:
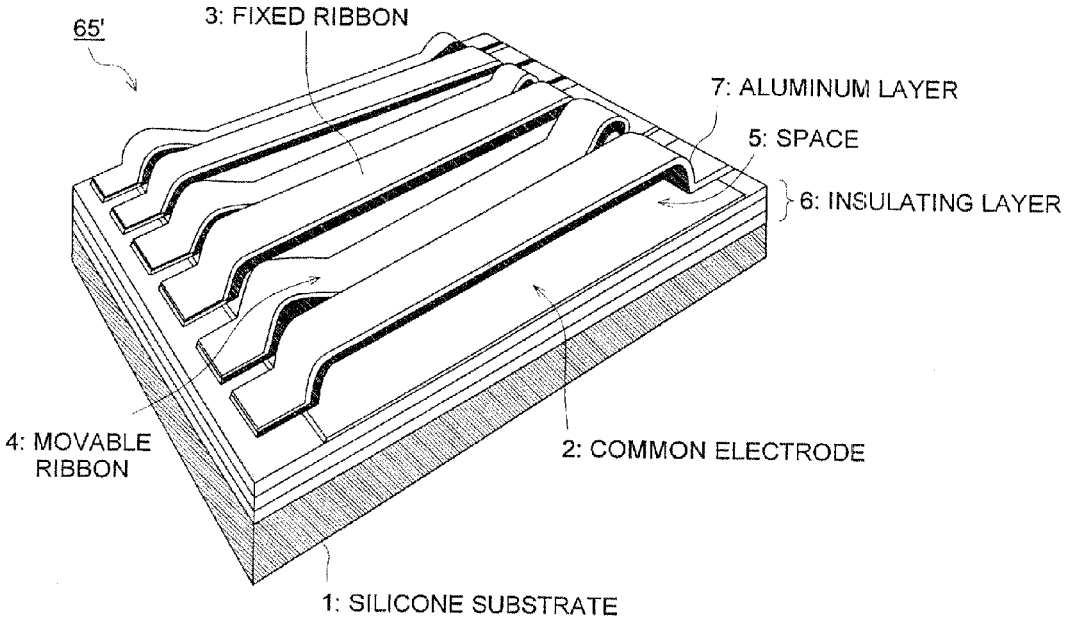
FIG. 17 PRIOR ART
FIG. 17 is a perspective view showing an example of the configuration for one pixel of the diffraction grating type light valve 65' in a conventional example.
Figure 18:
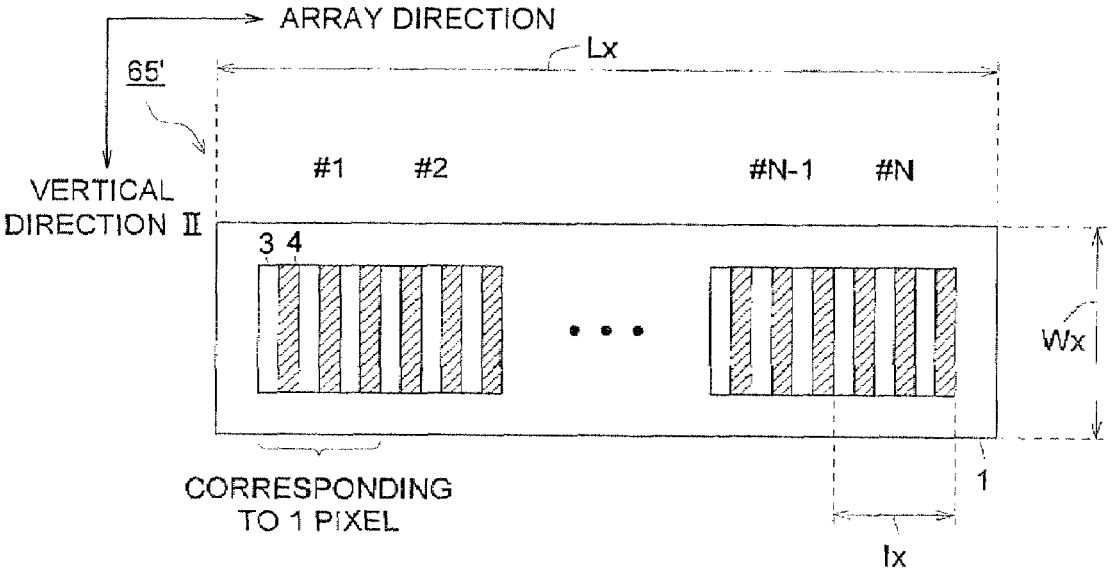
FIG. 18 PRIOR ART
FIG. 18 is a plan view showing an example of the overall configuration of the light valve 65'.
Figure 19:
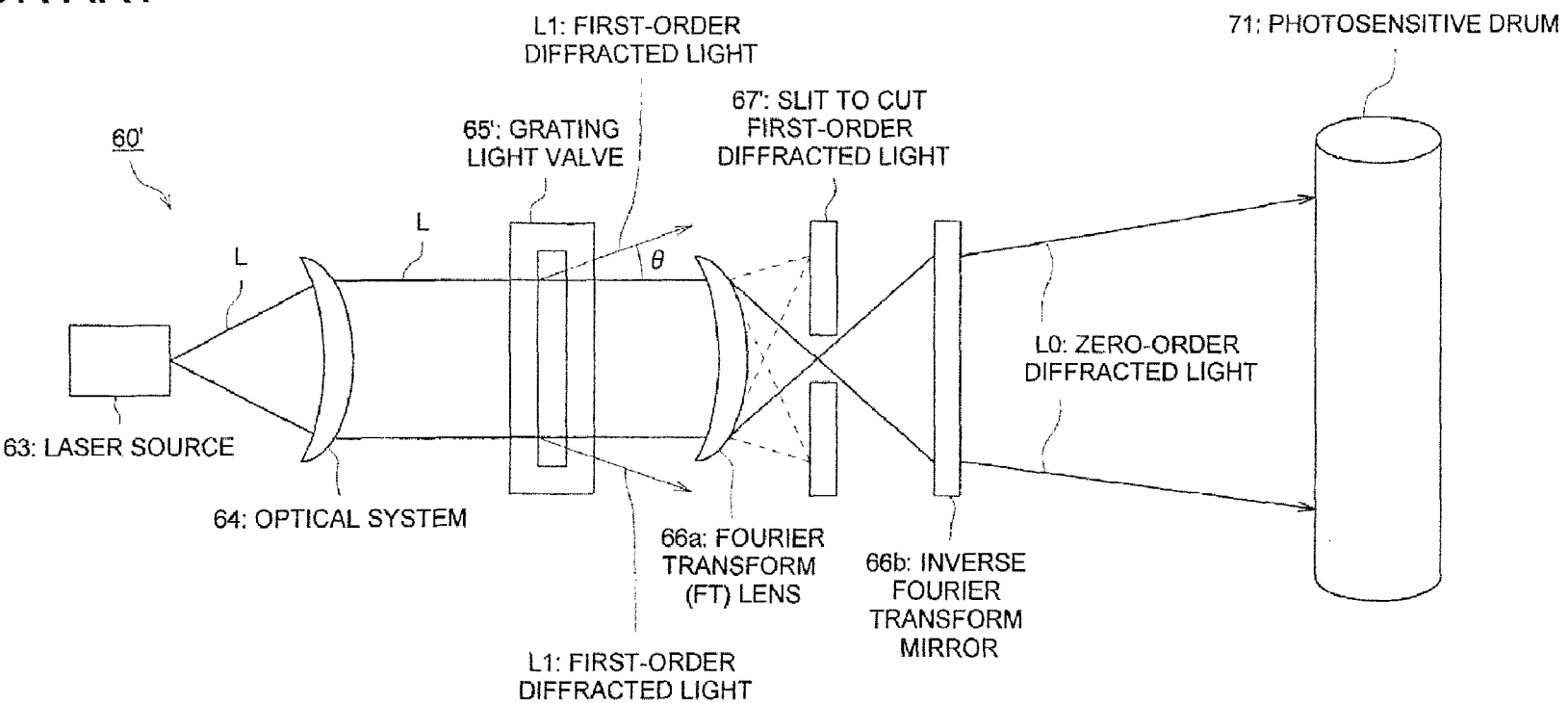
FIG. 19 PRIOR ART
FIG. 19 is a top view showing the principle of exposure in the image writing section 60' in a conventional example.

Next, an example of the operations of a copying machine 100 is described below. FIG. 16 is a flow chart showing an example of the operations during copying in the copying machine 100.

In this preferred embodiment, the presumption is the case of recording an electrostatic latent image on the photosensitive drum 71 using a diffraction grating type light valve configured using three fixed ribbons 3, a left movable ribbon 4L, a central movable ribbon 4C, and a right movable ribbon 4R for each pixel. In this example, for the outline sections such as inclined straight lines or smooth curves etc. present in text characters or figures in the images formed using the image data $D_{OUT}'$, that image data is expanded beforehand in the memory and pattern recognition (outline recognition processing) is carried out on it.

Based on this pattern recognition processing, a judgment is made as to whether or not to carry out smoothing processing of increasing or decreasing the widths of those pixels. The example is given here for the case when the decision that smoothing processing is "Required" is made during this step and it is determined to increase the width of a pixel, and smoothing processing is carried out so as to add the drive control of the pair of ribbons comprising the fixed ribbon 3 and the left movable ribbon 4L or the pair of ribbons comprising the fixed ribbon 3 and the right movable ribbon 4R that is nearest to the boundary between that pixel and its neighboring pixel, or to delete the drive control of the pair of ribbons comprising the fixed ribbon 3 and the left movable ribbon 4L or the pair of ribbons comprising the fixed ribbon 3 and the right movable ribbon 4R that is nearest to the boundary between that pixel and its neighboring pixels. In this example, M=8 and the smoothing patterns P1 to P8 are prepared beforehand.

After setting these as the copying conditions, the copying request is awaited in Step A1 of the flow chart shown in FIG. 16. When a copying request is made, the operation goes on to Step A2 and the input operations of the image forming conditions are made. At this time, a basic settings screen etc., not shown in the figures here displayed in the display section 18, and the image forming conditions such as the number of copies, image formation density, etc., are displayed in this screen. The image forming conditions are displayed based on the display data D2. Operations are then made in the operations setting section 14 so as to set the automatic paper feed mode, the plate glass mode, etc., and to select or set the image forming conditions. The operation data D3 obtained due to the selection etc. of these image forming conditions is output to the control section 15.

Thereafter, the operations move on to Step A3, and the control section 15 awaits the pressing of the Start button in the operation panel 48 not shown in the figure. When this Start button is pressed, the control section 15 goes on to Step A4 and controls the original document reading section 11 so as to carry out the processing of reading out the original document. At this time, the original document reading section 11 outputs the original document read out signal Sout obtained by reading the original document 20 to the control section 15 as has been explained in the descriptions for FIG. 1. The control section 15 carries out analog to digital (A/D) conversion of the original document read out signal Sout and transfers the original document image data $D_{IN}$ after analog to digital (A/D) conversion to the image processing section 21. In the image processing section 21, after the encoding and compression processing of the original document image data $D_{IN}$ has been made, the compressed original document image data $D_{OUT}$ is transferred to the image memory 13.

Further, the CPU 35 reads out the original document image data $D_{IN}$ from the image memory 13 based on the image forming conditions set using the operations settings section 14. The original document image data $D_{IN}$ read out from the image memory 13 is transferred to the image processing section 21. The decoding and expansion processing of the original document image data $D_{IN}$ is made in the image processing section 21. The smoothing processing is made in Step A5 for the original document image data $D_{IN}$ after image processing.

At this time, in the image processing section 21 shown in FIG. 9, the smoothing processing is carried out based on the image processing signal S1 output from the CPU 35. The image processing section 21 not only carries out pattern recognition by successively scanning the search window frames with areas corresponding to 3×3 pixels for the image based on, for example, the image data $D_{OUT}'$ of one page that has been expanded in the memory, but also outputs the image data DL or DR for the pixels that "require" smoothing processing by preparing them from the image data DOUT' of the current line.

For example, the working memory area 22 receives and stores the image data $D_{IN}$ in units of one page from the image memory 13 based on the memory control signal Sm0. The shift register 26 connected to the working memory area 22 receives the input of the image data $D_{OUT}'$ of the concerned line and latches the image data D [1] of the pixel diagonally above to the left as seen from the target pixel, the image data D [2] of the pixel immediately above the target pixel, and the image data D [3] of the pixel diagonally above to the right as seen from the target pixel. The image data D [1], D [2], and D [3] corresponding to three pixels are output from the shift register 26 to the pattern recognition section 29.

Further, the line buffer 23 stores the image data $D_{OUT}'$ delayed by one line from the concerned line after reading it out from the working memory area 22 based on the memory control signal Sm1. The shift register 27 reads the image data $D_{OUT}'$ of the concerned line from the line buffer 23 and latches the image data D [4] of the pixel to the left as seen from the target pixel, the image data D [5] of the target pixel itself, and the image data D [6] of the pixel to the right as seen from the target pixel. The image data D [4], D [5], and D [6] corresponding to three pixels are output from the shift register 27 to the pattern recognition section 29.

In addition, the line buffer 24 stores the image data $D_{OUT}'$ delayed by two lines from the concerned line after reading it out from the working memory area 22 based on the memory control signal Sm2. The shift register 28 latches the image data D [7] of the pixel diagonally below to the left as seen from the target pixel of the image data $D_{OUT}'$ of the concerned line, the image data D [8] of the pixel immediately below the target pixel, and similarly the image data D [9] of the pixel diagonally below to the right as seen from the target pixel. Because of this, successive scanning is made of the search window frames with areas corresponding to 3×3 pixels for the image that has been expanded in the memory.

The pattern recognition section 29 reads out the pattern data Pi [j] for 8 types of smoothing patterns P1 to P8 shown in FIG. 13 from the pattern ROM 31 based on the memory control signal Sm3. The pattern recognition and the generation of the image data DL, DC, and DR shown in FIG. 14 and FIG. 15 for each of the ribbons are made in the pattern recognition section 29.

At this time, the pattern recognition section 29 shown in FIG. 10 receives inputs of the image data $D_{OUT}'$ and the pattern data Pi [j] for each image corresponding to a window frame equivalent to 3×3 pixels and computes their exclusive OR sum. For example, in the first processing block B#1, the 2-input Exclusive NOR circuit 901 takes as input the image data D [1] and the pattern data P1 [1] and computes their logical Exclusive OR sum and outputs the negation of that result to the 9-input logical product circuit 910.

The 2-input Exclusive NOR circuit 902 takes as input the image data D [2] and the pattern data P1 [2], computes their logical Exclusive OR sum and outputs the negation of that result to the 9-input logical product circuit 910. The 2-input Exclusive NOR circuit 903 takes as input the image data D [3] and the pattern data P1 [3], computes their logical Exclusive OR sum and outputs the negation of that result to the 9-input logical product circuit 910. The 2-input Exclusive NOR circuit 904 takes as input the image data D [4] and the pattern data P1 [4], computes their logical Exclusive OR sum and outputs the negation of that result to the 9-input logical product circuit 910.

The 2-input Exclusive NOR circuit 905 takes as input the image data D [5] and the pattern data P1 [5], computes their logical Exclusive OR sum and outputs the negation of that result to the 9-input logical product circuit 910. The 2-input Exclusive NOR circuit 906 takes as input the image data D [6] and the pattern data P1 [6], computes their logical Exclusive OR sum and outputs the negation of that result to the 9-input logical product circuit 910. The 2-input Exclusive NOR circuit 907 takes as input the image data D [7] and the pattern data P1 [7], computes their logical Exclusive OR sum and outputs the negation of that result to the 9-input logical product circuit 910. The 2-input Exclusive NOR circuit 908 takes as input the image data D [8] and the pattern data P1 [8], computes their logical Exclusive OR sum and outputs the negation of that result to the 9-input logical product circuit 910.

The 2-input Exclusive NOR circuit 909 takes as input the image data D [9] and the pattern data P1 [9], computes their logical Exclusive OR sum and outputs the negation of that result to the 9-input logical product circuit 910. All the negated signals output from the 2-input Exclusive NOR circuits 901 to 909 are input to the 9-input logical product circuit 910 which computes their logical product, and the output signal of this computation is output to the judgment of number agreement section 900.

When the image data D [1] to D [9] match with the pattern data Pi [j] for all the pixels, the logical product for that smoothing pattern becomes "1". In a similar manner, even in the second to eighth processing blocks B#2 to B#8, the various exclusive OR sums are evaluated, the logical product of the negated signals of the results of all these sums is computed, and the output signals corresponding to these results of computations are output to the judgment of number agreement section 900. In the judgment of number agreement section 900, the logical product results of the eight 9-input logical product circuits 910, 920, . . . are collected together, and the matching number is output to the selectors 97 to 99 as the judgment result number.

The image data D [5] of the target pixel and the image data DL1 to DL8 for the left ribbon corresponding to the 8 types of smoothing patterns P1 to P8 are input to selector 97 shown in FIG. 10, and one image data DL is selected from among the 9 image data D [5] and DL1 to DL8 for the left ribbon based on the selector selection signal SS1. When, for example, the selector selection signal SS1 corresponding to "1" is input to the selector 97 as the judgment result number, the image data DL1 for the left ribbon corresponding to the smoothing pattern P1 will be selected and output by this selector 97.

Further, when the selector selection signal SS1 corresponding to "2" is input to the selector 97, the image data DL2 for the left ribbon corresponding to the smoothing pattern P2 will be selected, and when the selector selection signal SS1 corresponding to "3" is input to the selector 97, the image data DL3 for the left ribbon corresponding to the smoothing pattern P3 will be selected. Similarly, when the selector selection signal SS1 corresponding to "8" is input to the selector 97, the image data DL8, for the left ribbon corresponding to the smoothing pattern P8 will be selected, and this selected signal is input to the image writing section 60 as the image data DL for the left ribbon.

The image data D [5] of the target pixel and the image data DC1 to DC8 for the central ribbon corresponding to the 8 types of smoothing patterns P1 to P8 are input to selector 98 shown in FIG. 10, and one image data DC is selected from among the 9 image data D [5] and DC1 to DC8 for the central ribbon based on the selector selection signal SS2. When, for example, the selector selection signal SS2 corresponding to "1" is input to the selector 98 as the judgment result number, the image data DC1 for the central ribbon corresponding to the smoothing pattern P1 will be selected.

Further, when the selector selection signal SS2 corresponding to "2" is input to the selector 98, the image data DC2 for the central ribbon corresponding to the smoothing pattern P2 will be selected, and when the selector selection signals SS2 corresponding to "3" is input to the selector 98, the image data DC3 for the central ribbon corresponding to the smoothing pattern P3 will be selected. Similarly, when the selector selection signals SS2 corresponding to "8" is input to the selector 98, the image data DC8 for the central ribbon corresponding to the smoothing pattern P8 will be selected, and this selected signal is input to the image writing section 60 as the image data DC for the central ribbon.

The image data D [5] of the target pixel and the image data DR1 to DR8 for the right ribbon corresponding to the 8 types of smoothing patterns P1 to P8 are input to selector 99 shown in FIG. 10, and one image data DR is selected from among the 9 image data D [5] and DR1 to DR8 for the right ribbon based on the selector selection signals SS1 to SS3. When, for example, the selector selection signals SS1 to SS3 corresponding to "1" are input to the selector 99 as the judgment result number, the image data DR1 for the right ribbon corresponding to the smoothing pattern P1 will be selected and output by this selector 99.

Further, when the selector selection signals SS1 to SS3 corresponding to "2" are input to the selector 99, the image data DR2 for the right ribbon corresponding to the smoothing pattern P2 will be selected and output by this selector 99, and, when the selector selection signals SS1 to SS3 corresponding to "3" are input to the selector 99, the image data DR3 for the right ribbon corresponding to the smoothing pattern P3 will be selected and output by this selector 99. Similarly, when the selector selection signals SS1 to SS3 corresponding to "8" are input to the selector 99, the image data DR8 for the right ribbon corresponding to the smoothing pattern P8 will be selected, and this selected signal is input to the image writing section 60 as the image data DR for the right ribbon.

Further, when the judgment result number is "0", the original image data $D_{OUT}'$ will not be changed but will be output as it is to the image writing section 60. For example, when not even one judgment result is present for which the logical product is equal to "1", the selector selection signals SS1 to SS3 corresponding to "0" are respectively input to the selector 97 for the left ribbon, to the selector 98 for the central ribbon, and to the selector 99 for the right ribbon. Because of this, it is possible to generate the image data DL, DC, and DR for the left, central, and the right ribbons corresponding to the judgment result number, and these image data DL, DC, and DR can be output to the image writing section 60.

Thereafter, the operation moves to Step A6 and the CPU 35 controls the paper feeding section 30 in order to execute the paper feeding process. During this step, in the paper feeding tray of the paper feeding section 30, for example, in the paper feeding tray 30A, the paper P is sent out based on the paper feed control signal S6, and is transported to the underside of the image forming section 70 after passing through the paper transport path.

And, the operation moves to Step A7 in which the CPU 35 controls the image forming section 70 in order to carry out the image forming processing. For example, the CPU 35 carries out the control during the image writing operation by outputting the light source control signal $S_{LD}$, the charging control signal S3, the driving control signal S4, the development control signal S5, the image transfer control signal S7, and the separation control signal S8 to the image forming section 70.

In the image writing section 60, an electrostatic latent image corresponding to the image data DL, DC, and DR is formed on the photosensitive drum 71 based on the image processing signal S1. In this example, during the period between lines when no data is written, the CPU controls the positions of the left movable ribbon 4L, the central movable ribbon 4C, and the right movable ribbon 4R with respect to the fixed ribbon 3 based on the image data $D_{OUT}'$ of the next line (ribbon modulation control). At this time, the timing generator circuit 25 generates the ON/OFF control signal S2 based on the timing control signal S10 from the CPU 35. This signal S2 is output to the valve driving circuit 68.

In this example, the light source control signal $S_{LD}$ is maintained at the $S_{LD}$='L' level during the data non-writing period and thereby switches OFF the laser light source 63. The light valve 65 carries out the ribbon modulation operation with the laser light source 63 in the OFF state. For example, in the light valve driving circuit 68 shown in FIG. 11, the image data DL, DC, and DR for each of the left, central, and right ribbons are input from the selectors 97 to 99 and each of the left, central, and right ribbons 4L, 4C, and 4R are driven independently. For example, the shift register 81L receives the input of the serial image data of N pixels after smoothing processing from the pattern recognition section 29 and latches (holds) it. After latching, the image data DL is output to the D/A converter 82L. The D/A converter 82L reads the digital image data DL for N pixels in the parallel mode from the shift register 81L, and in a similar manner, outputs the analog image signal Sout' for that left ribbon.

Even the shift register 81C receives the input of the serial image data of N pixels after smoothing processing from the pattern recognition section 29 and latches it. After latching, the image data DC is output to the D/A converter 82C. The D/A converter 82C reads the digital image data DC for N pixels in the parallel mode from the shift register 82C, and in a similar manner, outputs the analog image signal Sout' for that central ribbon.

Even the shift register 81R receives the input of the serial image data of N pixels after smoothing processing from the pattern recognition section 29 and latches it. After latching, the image data DR is output to the D/A converter 82R. The D/A converter 82R reads the digital image data DR for N pixels in the parallel mode from the shift register 81R, and in a similar manner, outputs the analog image signal Sout' for that right ribbon.

The analog image signals Sout" for each of the ribbons converted in the respective D/A converters 82L, 82C, and 82R are output to the switching circuit 84. The offset circuit 83 outputs the offset voltage Voff to the switching circuit 84 based on the offset control signal S11. In the switching circuit 84, during the image writing period based on the ON/OFF control signal S2, the offset voltage Voff based on the analog image signal Sout' for the left movable ribbon 4L, the central movable ribbon 4C, and the right movable ribbon 4R is output as the writing voltage Vw to the pixels #1 to #N of the light valve 65.

In the light valve 65, for each pixel, ON/OFF operation is made based on the writing voltage Vw after smoothing processing as is shown in FIG. 4 and FIG. 5. Because of the ON/OFF operation of the light valve 65 it is possible to carry out modulation of the laser light L along with smoothing processing (outline correction). The zero order diffracted light L0 after this modulation is passed through the slit 67 shown in FIG. 7 and FIG. 8 and is projected on to the photosensitive drum 71. Because of this, it is possible to write at one time (form an image) on the photosensitive drum 71 the 0th order diffracted light L0 based on the image data DL, DC, and DR in units of a line. In this example, it is possible to form the image of an inclined line smooth as is shown in FIG. 12 (A).

Further, the control section 15 rotates the photosensitive drum 71 on which the image in units of a line has been formed in a specific direction via the driving section 79. The electrostatic latent image formed on the photosensitive drum 71 is developed by the developing unit 73 based on the development control signal S5 thereby forming the toner image. In the image transfer unit 74, the toner image formed on the photosensitive drum 71 is transferred on to the paper P based on the image transfer control signal S7. In the separating unit 75 separates the paper on to which the toner image has been transferred from the photosensitive drum 71 based on the separation control signal S8. The toner image formed on the paper P is fixed in the fixing unit 78 based on the fixing control signal S9. The paper P is discharged to outside the image forming apparatus after fixing.

Thereafter, the operation moves to Step A8 during which the CPU 35 judges whether the copying has been executed for the previously set number of copies. When the last page of the number of copies specified earlier for the original document 20 has been copied, the operation moves to Step A9. If the last page of the number of copies specified earlier has not been copied, the operation returns to Step A6 and repeats the above processing. Next, the CPU 35 when the number of copies set previously has been made completely moves to Step A9 and checks whether or not to terminate the copying operations. If the copying operations are not to be terminated, the operations return to Step A1 and starts waiting for a copying request. If the copying operations have to be terminated, the controlling operations are terminated after detecting the power OFF information etc.

In this manner, in the high speed digital copying equipment and the optical signal generating method utilizing the optical signal generating apparatus according to the present preferred embodiment, a diffraction grating type light valve 65 is provided having an N number of ribbon pairs arranged in parallel with the configuration of the light valve for each pixel having a fixed ribbon 3 and a left movable ribbon 4L, a fixed ribbon 3 and a central movable ribbon 4C, and a fixed ribbon 3 and a right movable ribbon 4R. At the time of forming the image on the photosensitive drum 71, the control section 15 drives independently each ribbon pair of the light valve separately for the fixed ribbon 3 and the left movable ribbon 4L, the fixed ribbon 3 and the central movable ribbon 4C, and the fixed ribbon 3 and the right movable ribbon 4R.

Therefore, it is possible to control the image formed on the photosensitive drum 71 with a resolution of 1/(N×number of pairs) pixels. As a result of this, at the border of a pixel and its neighboring pixels it is possible to shift the position of forming the image by one pixel or more in the array direction (main scanning direction) of the fixed ribbon 3 and the left movable ribbon 4L, the fixed ribbon 3 and the central movable ribbon 4C, and the fixed ribbon 3 and the right movable ribbon 4R. Because of this, for the outline portion such as inclined straight lines or smooth curves present in text characters or figures, it is possible to carry out smoothing processing of adding the drive control for a ribbon pair among the ribbon pairs of the fixed ribbon 3 and the left movable ribbon 4L, the fixed ribbon 3 and the central movable ribbon 4C, and the fixed ribbon 3 and the right movable ribbon 4R that is closest to the boundary between the concerned pixel and its neighboring pixels, or of deleting the drive control for a ribbon pair among the ribbon pairs of the fixed ribbon 3 and the left movable ribbon 4L, the fixed ribbon 3 and the central movable ribbon 4C, and the fixed ribbon 3 and the right movable ribbon 4R that is closest to the boundary between the concerned pixel and its neighboring pixels. Thus, it is possible to correct step-shaped jaggedness without causing reduction in the contrast or in the resolution, and to improve the image forming quality compared to the conventional methods.

In the preferred embodiment described above, although the case of a digital black and white copying machine was described, it is not necessary to restrict the present invention to this and it is also possible to apply the present invention to printers, facsimile equipment, and multi-functional apparatus for color also. In addition, the outline correction function of the present invention need not be limited to the light valve 65 but can of course be applied to a light valve 65' such as in a conventional method.

The present invention is extremely suitable for application to color and black-and-white printers, facsimile equipment, and multi-functional apparatus having an optical signal generator that generates optical signals based on image data and that are capable of high speed image writing operation.

The following effects can be obtained using the structures having the aspects of the present embodiments described earlier.

According to the information recording apparatus of structure (1), the diffraction grating type light valve that has a plurality of ribbons is placed so that the longitudinal direction of said ribbons is at a specific angle with respect to a direction at right angles to the array direction of said ribbons. With this as a pre-condition, when the image information is recorded on the image forming body, the light valve modulates the light emitted from the light source based on the image information. In this light valve, it is possible to rotate the optical axis of the diffracted light modulated by the ribbons by only a specific angle equal to the angle between the longitudinal direction of said ribbons and a direction at right angles to the array direction of said ribbons. Because of this, it is possible to shut-off (remove) easily the diffracted light components that are not necessary for recording the image information using a slit etc., with a simple structure. The optical device can form the image on the image forming body using only the ideally suitable diffracted light modulated by the light valve.

According to the information recording apparatus of structure (2), when recording information on the image forming body using a diffraction grating type light valve that has a plurality of ribbons, it is possible to rotate the optical axis of the diffracted light modulated by the ribbons by only a specific angle equal to the angle between the longitudinal direction of said ribbons and a direction at right angles to the array direction of said ribbons. Because of this, it is possible to shut-off (remove) easily the diffracted light components that are not necessary for recording the image information using a slit etc., with a simple structure.

In the information recording apparatus of structure (3), the information recording apparatus and the information recording method according to the present invention are being applied. The diffraction grating type light valve that has a plurality of ribbons is placed so that the longitudinal direction of said ribbons is at a specific angle with respect to a direction at right angles to the array direction of said ribbons. With this as a pre-condition, when the image is formed on the image forming body based on image information, the light valve modulates the light emitted from the light source based on the image information. In this light valve, the optical axis of the diffracted light modulated by the ribbons is rotated by only a specific angle equal to the angle between the longitudinal direction of said ribbons and a direction at right angles to the array direction of said ribbons.

According to the information recording apparatus of structure (4) and the optical signal generation method of structure (5), a control section is provided for controlling the diffraction grating type light valve for modulating the light in accordance with the image information in which N sets of ribbon pairs configured to have plural numbers of fixed and movable ribbons per pixel are arranged in parallel, and that control section that drives independently each pair of fixed and movable ribbons.

Because of this configuration, it is possible to carry out control with a higher resolution than the resolution of the pixels. Therefore, at the boundary between a target pixel and its neighboring pixels, it is possible to adjust the position of image formation along the array direction of the ribbons (for example, along the main scanning direction) by less than one pixel. As a result of this, it is possible to carry out boundary correction processing such as adding drive control of the pair of fixed and movable ribbons nearest to the boundary between the target pixel and its neighboring pixels, or removing drive control of pairs of fixed and movable ribbons nearest to the boundary between the target pixel and its neighboring pixels. Because of this, it is possible to correct step-shaped jaggedness without causing reduction in the contrast or in the resolution, and to improve the image forming quality compared to the conventional methods.

According to the image forming apparatus of structure (6), since the information recording apparatus of structure (4) and the optical signal generation method of structure (5) are being applied, it is possible to carry out control of the diffracted light forming an image on the image forming body with a higher resolution than the resolution of the pixels.

Because of this configuration, at the boundary between a target pixel and its neighboring pixels, it is possible to adjust the position of image formation along the array direction of the ribbons (for example, along the main scanning direction) by less than one pixel. As a result of this, it is possible to carry out boundary correction processing such as adding drive control of the pair of fixed and movable ribbons nearest to the boundary between the target pixel and its neighboring pixels, or removing drive control of pairs of fixed and movable ribbons nearest to the boundary between the target pixel and its neighboring pixels. Because of this, it is possible to correct step-shaped jaggedness without causing reduction in the contrast or in the resolution, and to improve the image forming quality compared to the conventional methods.

According to the optical signal generating apparatus of structure (7) or the optical signal generating method of structure (8), it is possible to make a judgment as to whether or not outline correction processing is required, and to carry out control of the optical modulator with a higher resolution than the resolution of one pixel. As a result of this, at the boundary between a target pixel and its neighboring pixels, it is possible to adjust the position of image formation along the array direction of the ribbons (for example, along the main scanning direction) by less than one pixel.

As a consequence of this, it is possible to carry out boundary correction processing such as adding drive control of the pair of fixed and movable ribbons nearest to the boundary between the target pixel and its neighboring pixels, or removing drive control of pairs of fixed and movable ribbons nearest to the boundary between the target pixel and its neighboring pixels. Because of this, it is possible to correct step-shaped jaggedness without causing reduction in the contrast or in the resolution, and to improve the image forming quality compared to the conventional methods.

What is claimed is:

1. A light modulating apparatus comprising:

a light source for emitting light;

a light valve of diffraction grating type for modulating the light emitted from the light source in accordance with image information, the light valve comprising plural sets of ribbon pairs arranged in parallel, each set of the plural sets of ribbon pairs having a plurality of pairs of a fixed ribbon and a movable ribbon, and each set being assigned to one pixel of an image; and a control section that drives independently each pair of the fixed ribbon and the movable ribbon;

wherein the control section further executes an outline recognition processing based on the image information, and based on the outline recognition processing determines whether an outline correction processing for increasing or decreasing a width of a target pixel in an array direction of the ribbons is necessary;

wherein:

when the control section has determined that increasing the width of the target pixel is necessary, a driving condition of a ribbon pair in an adjoining pixel that is nearest to a border between the adjoining pixel and the target pixel is made the same as a driving condition of plural ribbon pairs assigned to the target pixel; and when the control section has determined that decreasing the width of the target pixel is necessary, a driving condition of a ribbon pair in the target pixel that is nearest to a border between an adjoining pixel and the target pixel is made different from a driving condition of remaining ribbon pairs assigned to the target pixel.

2. The light modulating apparatus of claim 1, wherein a longitudinal direction of the ribbons of the light valve is arranged at an angle with respect to a direction perpendicular to the array direction of the ribbons.

3. An image forming apparatus comprising:

an image forming body;

an information recording section for recording an electrostatic latent image on the image forming body, wherein the information recording section comprises the light modulating apparatus of claim 1;

an image forming section for forming a visible image by visualizing the electrostatic latent image recorded on the image forming body; and an optical section for forming an image on the image forming body with the light diffracted and modulated by the light valve.

4. An optical signal generating method for generating an optical signal by using a light valve of diffraction grating type, the light valve comprising a plurality of sets of ribbon pairs arranged in parallel, each set of the plural sets of ribbon pairs having a plurality of pairs of a fixed ribbon and a movable ribbon, and each set being assigned to one pixel of an image, the optical signal generating method comprising:

emitting light onto the light valve;

modulating the emitted light according to image information by driving independently each pair of the fixed ribbon and the movable ribbon;

executing an outline recognition processing based on the image information; and determining, based on the outline recognition processing, whether an outline correction processing for increasing or decreasing a width of a target pixel in an array direction of the ribbons is necessary;

wherein:

when increasing the width of the target pixel is determined to be necessary, a driving condition of a ribbon pair in an adjoining pixel that is nearest to a border between the adjoining pixel and the target pixel is made the same as a driving condition of plural ribbon pairs assigned to the target pixel; and when decreasing the width of the target pixel is determined to be necessary, a driving condition of a ribbon pair in the target pixel that is nearest to a border between an adjoining pixel and the target pixel is made different from a driving condition of remaining ribbon pairs assigned to the target pixel.

5. The optical signal generating method of claim 4, wherein a longitudinal direction of the ribbons of the light valve is arranged at a specific angle with respect to a direction perpendicular to the array direction of the ribbons.

6. An optical signal generating apparatus for generating an optical signal based on image information, comprising:

an optical signal generator having optical modulators corresponding to a plurality of pixels so that each pixel comprises at least two of the optical modulators, the optical modulators being arranged in an array;

a control section that drives independently each of the plurality of optical modulators, wherein the control section executes an outline recognition processing based on the image information, and based on the outline recognition processing determines whether an outline correction processing for increasing or decreasing a width of a target pixel in an array direction of the optical modulators is necessary;

wherein:

when the control section has determined that increasing the width of the target pixel is necessary, a driving condition of an optical modulator in an adjoining pixel that is nearest to a border between the adjoining pixel and the target pixel is made the same as a driving condition of plural optical modulators assigned to the target pixel; and when the control section has determined that decreasing the width of the target pixel is necessary, a driving condition of an optical modulator in the target pixel that is nearest to a border between an adjoining pixel and the target pixel is made different from a driving condition of remaining optical modulators assigned to the target pixel.

7. An optical signal generating method for generating an optical signal based on image information by using an optical signal generator having optical modulators of a plurality of pixels arranged in an array so that each pixel comprises at least two optical modulators, the optical signal generating method comprising:

executing an outline recognition processing based on the image information; and determining, based on the outline recognition processing, whether an outline correction processing for increasing or decreasing a width of a target pixel in the array direction is necessary;

wherein:

when increasing the width of the target pixel is determined to be necessary, a driving condition of an optical modulator in an adjoining pixel that is nearest to a border between the adjoining pixel and the target pixel is made the same as a driving condition of plural optical modulators assigned to the target pixel; and when decreasing the width of the target pixel is determined to be necessary, a driving condition of an optical modulator in the target pixel that is nearest to a border between an adjoining pixel and the target pixel is made different from a driving condition of remaining optical modulators assigned to the target pixel.

* * * * *